US005665675A

United States Patent [19]

Nagai et al.

[11] Patent Number: 5,665,675

[45] Date of Patent: Sep. 9, 1997

[54] AMINOBENZENESULFONAMIDE DERIVATIVE AND RECORDING MEDIUM USING THE SAME

[75] Inventors: Tomoaki Nagai; Kaoru Hamada; Akio Sekine, all of Tokyo, Japan

[73] Assignee: Nippon Paper Industries Co., Ltd., Tokyo, Japan

[21] Appl. No.: 504,784

[22] Filed: Jul. 20, 1995

[30] Foreign Application Priority Data

| | | | |
|---|---|---|---|
| Jul. 21, 1994 | [JP] | Japan | 6-168516 |
| Aug. 10, 1994 | [JP] | Japan | 6-187649 |
| Aug. 19, 1994 | [JP] | Japan | 6-195568 |
| Nov. 4, 1994 | [JP] | Japan | 6-270959 |
| Apr. 21, 1995 | [JP] | Japan | 7-097021 |
| May 22, 1995 | [JP] | Japan | 7-122393 |

[51] Int. Cl.[6] ..... B41M 5/30

[52] U.S. Cl. ..... 503/216; 503/209; 503/225

[58] Field of Search ..... 427/150; 503/216, 503/225

[56] References Cited

U.S. PATENT DOCUMENTS

| | | | |
|---|---|---|---|
| 4,507,670 | 3/1985 | Motosugi et al. | 503/208 |
| 4,517,580 | 5/1985 | Iiyama et al. | 503/214 |

FOREIGN PATENT DOCUMENTS

| | | | |
|---|---|---|---|
| 0104353 | 4/1984 | European Pat. Off. | 503/216 |
| 0526072 | 2/1993 | European Pat. Off. | 503/216 |
| 54-004142 | 1/1979 | Japan | 503/209 |
| 57-11090 | 1/1982 | Japan | 430/945 |
| 58-94494 | 6/1983 | Japan | 503/209 |
| 58-148776 | 9/1983 | Japan | 430/945 |
| 58-209594 | 12/1983 | Japan | 428/64 |
| 2206583 | 8/1990 | Japan | 428/64 |
| 2217287 | 8/1990 | Japan | 428/64 |
| 0373814 | 3/1991 | Japan | 428/64 |
| 0386580 | 4/1991 | Japan | 428/64 |
| 3207688 | 9/1991 | Japan | 428/64 |
| 3239598 | 10/1991 | Japan | 430/945 |
| 4353490 | 12/1992 | Japan | 503/217 |
| 0524366 | 2/1993 | Japan | 503/216 |
| 641168 | 2/1994 | Japan | 430/200 |

OTHER PUBLICATIONS

"Near-Infra Red Dyes", Chemical Industries, vol. 43, May 1986, pp. 379–387 (and partial translation).

*Primary Examiner*—Bruce H. Hess

*Attorney, Agent, or Firm*—Sherman and Shalloway

[57] ABSTRACT

In a thermal recording medium or an optically recordable thermal recording medium including a substrate having thereon a recording layer containing a colorless or pale colored dye precursor and a color developer reactable with the dye precursor to develop a color as main ingredients, the color developer includes at least one aminobenzenesulfonamide derivative of Formula (1):

(1)

(wherein X denotes oxygen atom or sulfur atom; and R denotes substituted or unsubstituted phenyl group, naphthyl group, aralkyl group, a lower alkyl group of 1 to 6 carbon atoms, cycloalkyl group, or a lower alkenyl group of 2 to 6 carbon atoms. Z denotes a lower alkyl group of 1 to 6 carbon atoms or an electron attracting group. n is an integer from 0 to 4.).

30 Claims, No Drawings

AMINOBENZENESULFONAMIDE DERIVATIVE AND RECORDING MEDIUM USING THE SAME

FIELD OF THE INVENTION

This invention relates to a thermal recording medium capable of thermal recording or optical recording with improved heat resistance which uses an aminobenzenesulfonamide derivative as a color developer.

BACKGROUND OF THE INVENTION

In general, a thermal recording sheet is obtained by mixing a normally colorless or pale colored dye precursor and a color developer such as a phenolic compound, each dispersed to fine particles and mixed, adding a binder, a filler, a sensitizer, a lubricant, and other additives to form a coating color, and coating the coating color on a substrate such as paper, synthetic paper, films, or plastics, which develops a color by a momentary chemical reaction caused by heating with a thermal head, a hot stamp, a thermal pen, laser light or the like to obtain a recorded image.

Thermal recording sheets are applied in a wide variety of areas such as measuring recorders, terminal printers for computers, facsimiles, automatic ticket venders, and bar code labels. However, with recent diversification of these recording devices and advance towards higher performance, quality requirements for thermal recording sheet have become higher and more difficult to achieve. For example, for high-speed recording, a thermal recording sheet which can provide a high recording density even with a small thermal energy is in demand. On the other hand, in view of storage stability of recording sheet, a thermal recording sheet is required which is superior in light resistance, heat resistance, water resistance, oil resistance, and plasticizer resistance.

Further, with the popularization of plain paper recording system such as electrophotographic or ink-jet systems, the thermal recording system has become often compared with these plain paper recording systems. For this reason, for example, stability of recorded portion or stability of unrecorded portion (background portion or white portion) before and after recording are required to be closer in quality to those of plain paper recording, as in the case of toner recording. Further, the thermal recording sheet is required to have a background color stability to heat of above 100° C because the thermal recording sheet is used as a label for foodstuffs which are subjected to, sterilization at high temperatures, and in cards such as skiing lift tickets which are heat laminated.

As to the background color stability of thermal recording material, for example, Japanese Patent Laid-open Publication (OPI) 04-353490 discloses a thermal recording material containing 3-dibutylamino-7-(o-chloroanilino) fluorane, 4-hydroxydiphenylsulfone compound having a melting point of above 120° C., and a mixture of sodium salt of 2,2'-methylenebis(4,6-di-tert-butylphenyl)phosphate and magnesium silicate having a relatively good background color stability and good stability of recorded image even at a high temperature of about 90° C.

On the other hand, recording on the thermal recording sheet is generally achieved by contacting a thermal head or IC pen as a heating element directly on the thermal recording paper. In this method, a color developing melt or the like tends to adhere to the heating element, resulting in a degraded recording function. Further, a thermal recording method using a thermal head is limited in increasing the density of the heating element, the resolution is typically about 10 dots/mm, and recording of a higher density is difficult. Then, a noncontacting recording method with light is proposed as a method for further improving the resolution without degrading the recording function.

Japanese Patent OPI 58-148776 discloses that thermal recording is possible using a carbon dioxide laser as a recording light source, by converging and scanning the laser light on the thermal recording paper. This recording method requires a high laser output power in spite of the fact that the thermal recording paper absorbs the oscillation wavelength of the carbon dioxide laser. The recording apparatus is impossible to be designed compact partly because of the use of a gas laser, and has a problem in fabrication cost.

Further, since conventional thermal recording paper is hard to absorb light in the visible and near-infrared regions, when a laser having an oscillation wavelength in the visible or near-infrared region, a required heat energy cannot be obtained unless the laser output power is increased to a great extent.

Still further, optical recording materials comprising combinations of conventional thermal recording materials and light absorbent materials are proposed in Japanese OPIs 54-4142, 57-11090, 58-94494, 58-209594, and so on.

Japanese OPI 54-4142 discloses that in a thermal recording medium having a substrate coated thereon with a thermal recording layer mainly comprising a leuco dye, using a metal compound having a lattice defect, the metal compound absorbs light of the visible or infrared region to convert it to heat, thereby enabling thermal recording. Japanese OPI 57-11090 describes an optical recording medium having a recording layer comprising a colorless or pale colored color forming substance, a phenolic substance, and an organic polymer binder, containing therein a benzenedithiol nickel complex as a light absorbent, which allows recording with laser light. Japanese OPI 58-94494 discloses recording medium having a substrate coated thereon with one or more thermal color forming materials, and one or more near-infrared absorbent material comprising a compound having a peak absorption wavelength in the near-infrared region of 0.7 to 31 μm. Japanese OPI 58-209594 discloses an optical recording medium characterized in that at least one set of a near-infrared absorbent material having an absorption wavelength in the near-infrared region of 0 8 to 21 μm and at least one thermal color forming material is coated on a substrate.

The thermal recording medium disclosed in Japanese OPI 04-353490 has a heat stability of background color (hereinafter referred to as "heat stability") that a Macbeth density of the background color is 0.11 after the medium is treated in a hot air dryer at 95° for 5 hours, which is fairly good in stability, but is yet insufficient in terms of heat resistance temperature.

With heat resistance of conventional thermal recording materials using a phenolic color developer, it has been impossible to heat laminate the recording surface or the entire recording medium with a film or the like after thermal recording. On the other hand, with heat resistance of conventional optically recordable thermal recording medium using a phenolic color developer as a recording material, when the unrecorded optically recordable thermal recording surface or the entire recording medium is heat laminated with a film or the like, or the recorded surface or the entire recording medium after thermal or optical recording is heat laminated with a film or the like, the overall surface develops a color, and is thus impracticable.

Therefore, a primary object of the present invention is to provide a thermal recording medium capable of thermal recording or optical recording which has a heat resistance to an extent that can be heat laminated.

SUMMARY OF THE INVENTION

The above object is attained by a thermal recording medium comprising a substrate having thereon a recording layer containing a colorless or pale colored dye precursor, and a color developer reactable with the dye precursor to develop a color as main ingredients, wherein the color developer includes at least one compound of Formula (1):

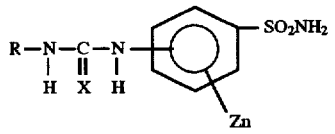

(1)

(wherein X denotes oxygen atom or sulfur atom; and R denotes substituted or unsubstituted phenyl group, naphthyl group, aralkyl group, a lower alkyl group of 1 to 6 carbon atoms, cycloalkyl group, or a lower alkenyl group of 2 to 6 carbon atoms. Z denotes a lower alkyl group of 1 to 6 carbon atoms or an electron attracting group. n is an integer from 0 to 5).

Although the thermal recording medium using the compound of Formula (1) as a color developer can be recorded with a thermal head or the like, it exhibits such characteristics that it is small in color developing of background color even in a thermal environment at 120° to 140° C., which cannot be considered to be achieved with conventional thermal recording paper.

The aminobenzenesulfonamide derivative of the present invention is considered to undergo a structural change from a neutral structure (keto-form in urea) shown by Formula (1) to an acid structure (enol-form in urea) to exhibit a color developing function. In order to stabilize the acid structure which is considered to exhibit a color developing function, it is sufficient that an aromatic ring(an aromatic nucleus) having an aminosulfonyl group ($—SO_2NH_2$) is present at the N-position (or 1-position) of the urea or thiourea structure of Formula (1) of the present invention. Therefore, R in Formula (1) may be one which does not hinder the color developing function or stability, for example, substituted or unsubstituted phenyl group, naphthyl group, aralkyl group, a lower alkyl group of 1 to 6 carbon atoms, cycloalkyl group, or a lower alkenyl group of 2 to 6 carbon atoms. Further, R in Formula (1) may include a substituent which does not hinder the color development and stability. The substituent includes lower alkyl groups of 1 to 6 carbon atoms such as methyl or ethyl; lower alkenyl groups such as isopropenyl; or an electron attracting group such as fluorine, chlorine, bromine, or nitro group. Further, Z in Formula (1) may be a substituent which does not hinder the color developing function and stability. Such a substituent includes lower alkyl groups of 1 to 6 carbon atoms such as methyl or ethyl; or an electron attracting group such as fluorine, chlorine, bromine, nitro group.

Practical examples of the compound of Formula (1) include, but are not limited to, (A-1) to (A-54), or (B-1) to (B-18) shown below.

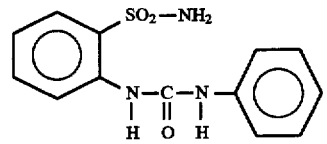

(A-1)

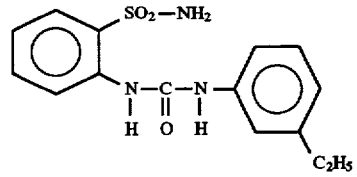

(A-2)

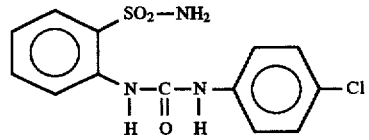

(A-3)

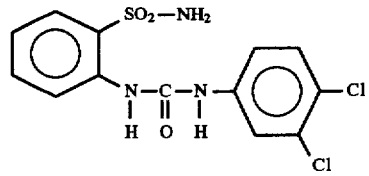

(A-4)

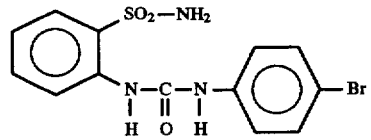

(A-5)

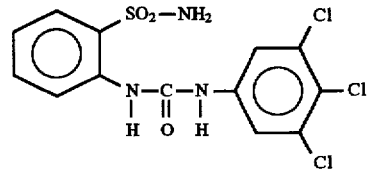

(A-6)

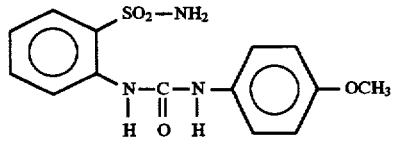

(A-7)

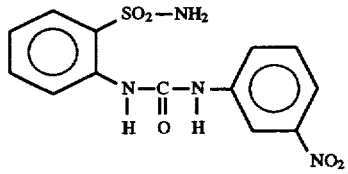

(A-8)

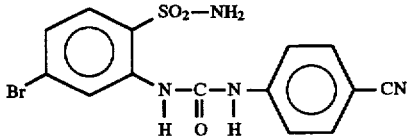

(A-9)

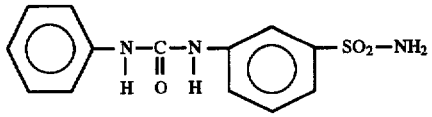

(A-10)

-continued
(A-11)
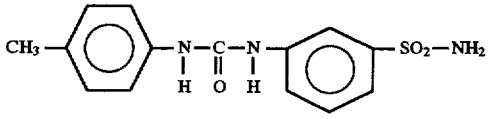
(A-12)
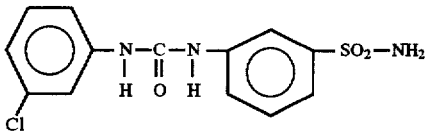
(A-13)
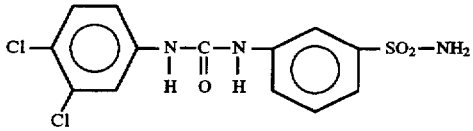
(A-14)
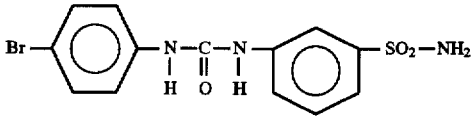
(A-15)
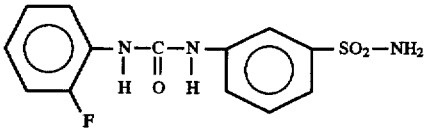
(A-16)
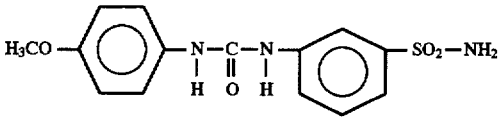
(A-17)
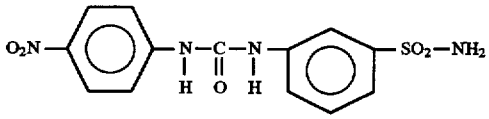
(A-18)
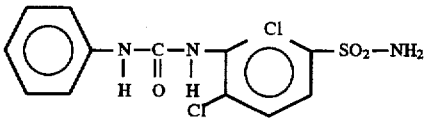
(A-19)
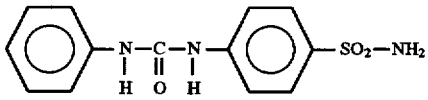
(A-20)
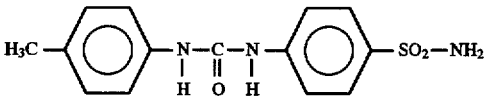
(A-21)
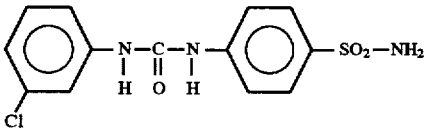
(A-22)
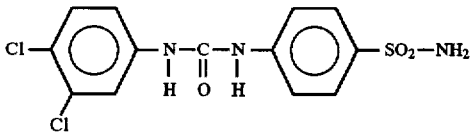
-continued
(A-23)
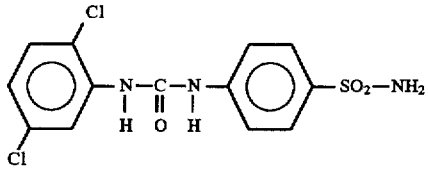
(A-24)
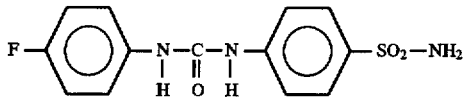
(A-25)
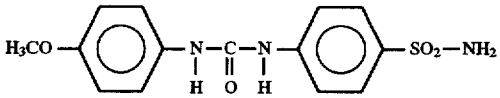
(A-26)
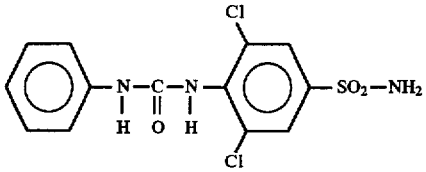
(A-27)
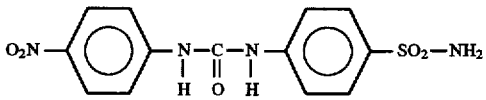
(A-28)
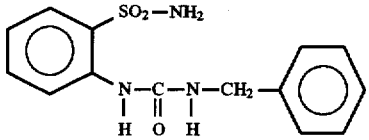
(A-29)
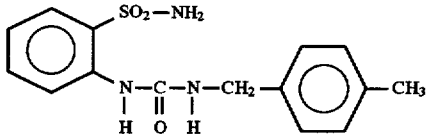
(A-30)
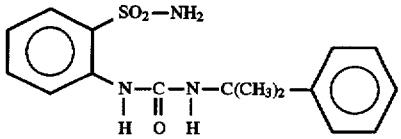
(A-31)
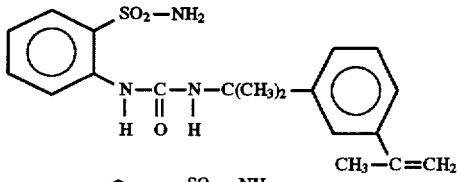
(A-32)
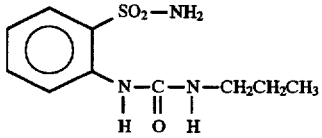
(A-33)
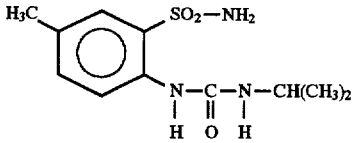

-continued
(A-34)
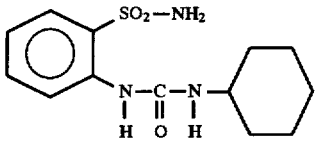
(A-35)
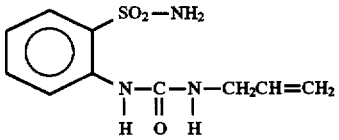
(A-36)
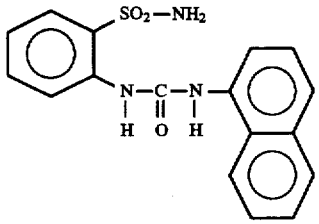
(A-37)
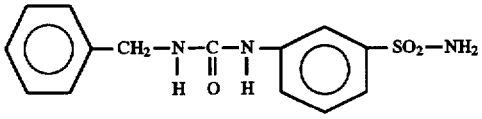
(A-38)
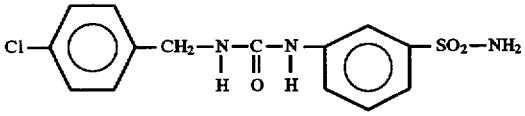
(A-39)
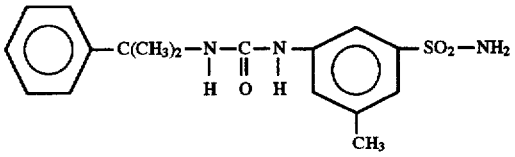
(A-40)
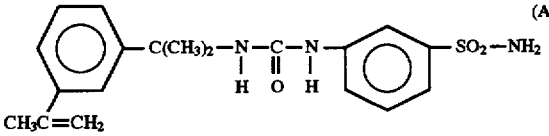
(A-41)
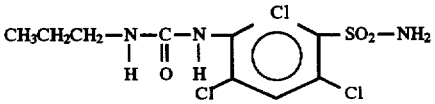
(A-42)
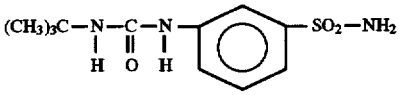
(A-43)
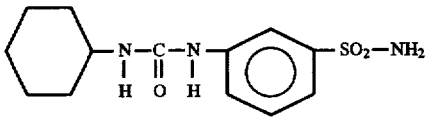
(A-44)
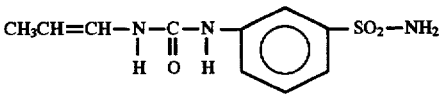
-continued
(A-45)
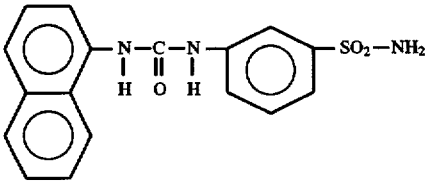
(A-46)
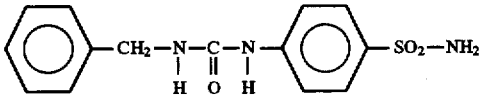
(A-47)
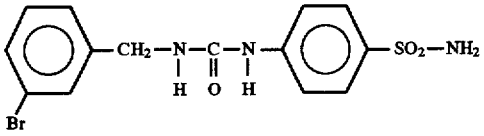
(A-48)
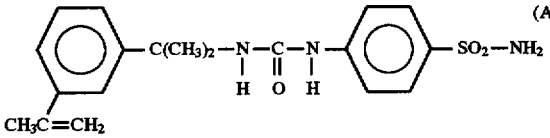
(A-49)
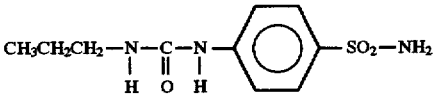
(A-50)
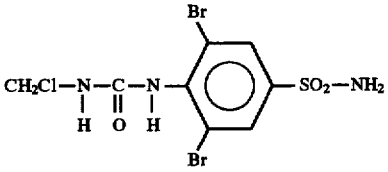
(A-51)
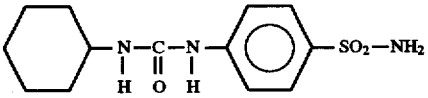
(A-52)
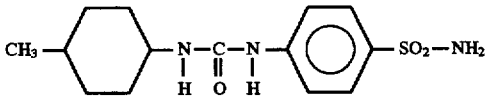
(A-53)
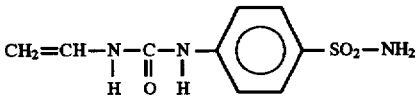
(A-54)
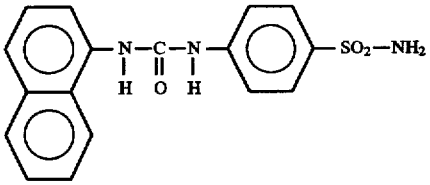
(B-1)
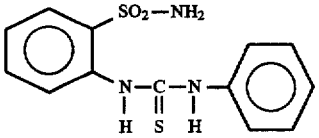

-continued (B-2)

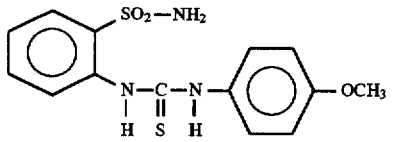

(B-3)

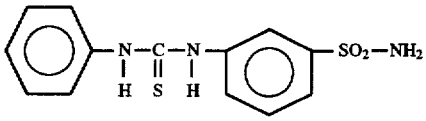

(B-4)

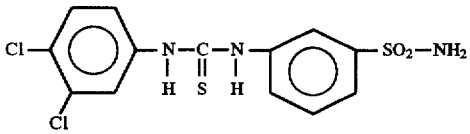

(B-5)

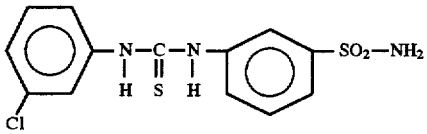

(B-6)

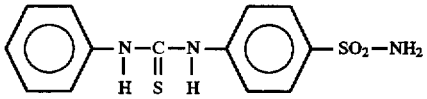

(B-7)

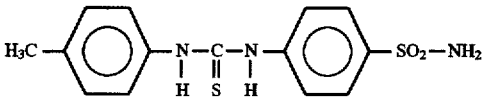

(B-8)

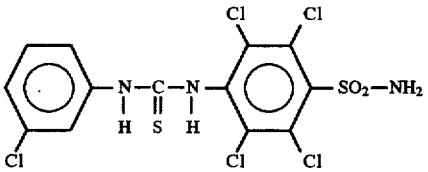

(B-9)

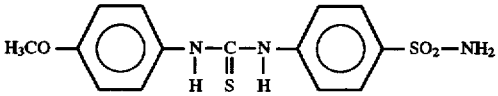

(B-10)

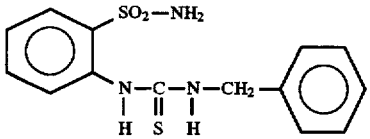

(B-11)

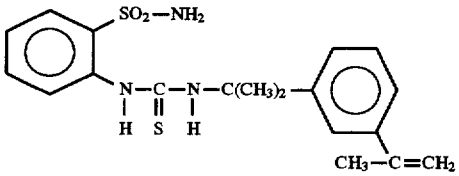

(B-12)

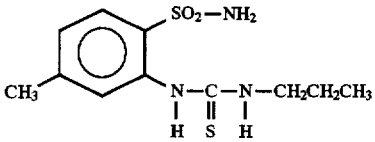

-continued (B-13)

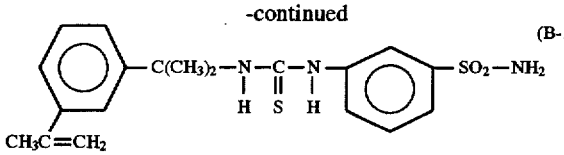

(B-14)

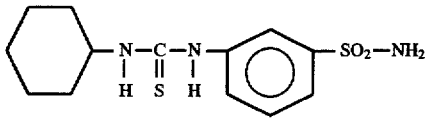

(B-15)

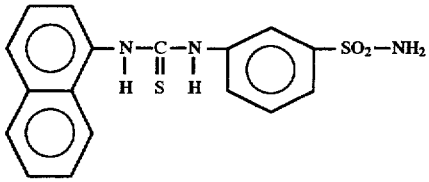

(B-16)

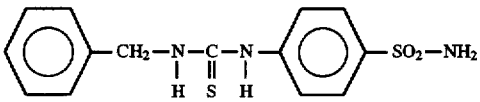

(B-17)

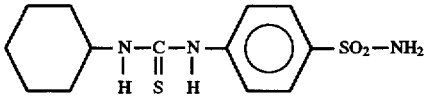

(B-18)

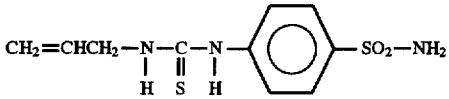

The compound of Formula (1) of the present invention can be produced by a reaction of aminobenzenesulfonamides with isocyanates or isothiocyanates. In the reaction, 1 mole of aminobenzenesulfonamide is added to 1 to 2.5 mole of isocyanates or isothiocyanates. The solvent used may be one which dissolves aminobenzenesulfonamides, isocyanates or isothiocyanates, including aromatic hydrocarbons such as benzene, toluene, and xylene; halogenated aromatic hydrocarbons such as chloroform, dichloromethane, and chlorobenzene; ethers such as diethylether, and tetrahydrofuran; nitriles such as acetonitrile, and propionitrile; esters such as ethylacetate; ketones such as acetone, and methylethylketone; dipolar aprotic solvents such as dimethylformamide, and dimethylsulfoxide; alcohols such as methanol, and ethanol; or mixtures thereof. The reaction temperature is 0° to 150° C., preferably 20° to 100° C.

In the recording medium of the present invention, the amino-benzenesulfonamides used as the color developer are preferably those of Formula (2) shown below, in view of availability, economy, and reactivity (yield) of the aminobenzenesulfonamides, isocyanates or isothiocyanates as raw materials. Specifically, those compounds of (A-1) to (A-8), (A-10) to (A-17), (A-19) to (A-25), or (A-27) can be used, but are not limited to.

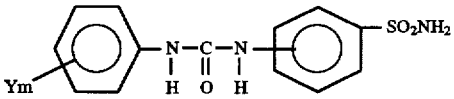

(2)

A general method for producing the thermal recording medium of the present invention is that a dye precursor, at least one compound of Formula (1), along with a binder, are individually dispersed, and a filler, a lubricant, an ultraviolet absorbing agent, a waterproofing agent, a defoamer, and the like are added as necessary, to produce a coating color, which is coated and dried on a substrate by a conventional method known in the art.

The coating color can be mixed with a known color developer for color developing the dye precursor and a known sensitizer.

The dye precursor used in the present invention can be conventional ones which are known in the conventional pressure-sensitive or thermal(heat-sensitive)recording paper area, and are not specifically limited. Specifically, triphenylmethane type compounds, fluoran type compounds, fluoran type compounds, and divinyl type compounds are preferable. Typical dye precursors are shown below. These dye precursors may be used alone or in combination.

<Triphenylmethane Type Leuco Dyes>

3,3-Bis(p-dimethylaminophenyl)-6-dimethylaminophthalide [Crystal Violet Lactone]

3,3-Bis(p-dimethylaminophenyl)phthalide [Malachite Green Lactone]

<Fluoran Type Leuco Dyes>

3-Diethylamino-6-methylfluoran
3-Diethylamino-6-methyl-7-anilinofluoran
3-Diethylamino-6-methyl-7-(o,p-dimethylanilino)fluoran
3-Diethylamino-6-methyl-7-chlorofluoran
3-Diethylamino-6-methyl-7-(m-trifluormethylanilino) fluoran
3-Diethylamino-6-methyl-7-(o-chloroanilino)fluoran
3-Diethylamino-6-methyl-7-(p-chloroanilino)fluoran
3-Diethylamino-6-methyl-7-(o-fluoroanilino)fluoran
3-Diethylamino-6-methyl-7-n-octylanilinofluoran
3-Diethylamino-6-methyl-7-n-octylaminofloutan
3-Diethylamino-6-methyl-7-benzylanilinofluoran
3-Diethylamino-6-methyl-7-dibenzylanilinofluoran
3-Diethylamino-6-chloro-7-methylfluoran
3-Diethylamino-6-chloro-7-anilinofluoran
3-Diethylamino-6-chloro-7-p-methylanilinofluoran
3-Diethylamino-6-ethoxyethyl-7-anilinofluoran
3-Diethylamino-7-methylfluoran
3-Diethylamino-7-chlorofluoran
3-Diethylamino-7-(m-trifluoromethylanilino)fluoran
3-Diethylamino-7-(o-chloroanilino)fluoran
3-Diethylamino-7-(p-chloroanilino)fluoran
3-Diethylamino-7-(o-fluoroanilino)fluoran
3-Diethylamino-benzo[a]fluoran
3-Diethylamino-benzo[c]fluoran
3-Dibutylamino-6-methyl-fluoran
3-Dibutylamino-6-methyl-7-anilinofluoran
3-Dibutylamino-6-methyl-7-(o,p-dimethylanilino)fluoran
3-Dibutylamino-6-methyl-7-(o-chloroanilino)fluoran
3-Dibutylamino-6-methyl-7-(p-chloroanilino)fluoran
3-Dibutylamino-6-methyl-7-(o-fluoroanilino)fluoran
3-Dibutylamino-6-methyl-7-(m-trifluoromethylanilino) fluoran
3-Dibutylamino-6-methyl-chlorofluoran
3-Dibutylamino-6-ethoxyethyl-7-anilinofluoran
3-Dibutylamino-6-chloro-7-anilinofluoran
3-Dibutylamino-6-methyl-7-p-methylanilinofluoran
3-Dibutylamino-7-(o-chloroanilino)fluoran
3-Dibutylamino-7-(o-fluoroanilino)fluoran
3-n-Dipentylamino-6-methyl-7-anilinofluorane
3-n-Dipentylamino-6-methyl-7-(p-chloroanilino)fluoran
3-n-Dipentylamino-6-chloro-7-anilinofluoran
3-n-Dipentylamino-7-(p-chloroanilino)fluoran
3-Pyrrolidino-6-methyl-7-anilinofluoran
3-Piperidino-6-methyl-7-anilinofluoran
3-(N-methyl-N-n-propylamino)-6-methyl-7-anilinofluoran
3-(N-methyl-N-cyclohexylamino)-6-methyl-7-anilinofluoran
3-(N-ethyl-N-cyclohexylamino)-6-methyl-7-anilinofluoran
3-(N-ethyl-N-hexylamino)-6-methyl-7-(p-chloroanilino) fluoran
3-(N-ethyl-p-toluidino)-6-methyl-7-anilinofluoran
3-(N-ethyl-N-isoamylamino)-6-methyl-7-anilino)fluoran
3-(N-ethyl-N-isoamylamino)-6-methyl-7-anilinofluoran
3-(N-ethyl-N-isoamylamino)-6-chloro-7-anilinofluoran
3-(N-ethyl-N-tetrahydrofurfurylamino)-6-methyl-7-anilinofluoran
3-(N-ethyl-N-isobutylamino)-6-methyl-7-anilinofluoran
3-Cyclohexylamino-6-chlorofluoran
2-(4-Oxahexyl)-3-dimethylamino-6-methyl-7-anilinofluoran
2-(4-Oxahexyl)-3-diethylamino-6-methyl-7-anilinofluoran
2-(4-Oxahexyl)-3-dipropylamino-6-methyl-7-anilinofluoran
2-Methyl-6-p-(p-dimethylaminophenyl) aminoanilinofluoran
2-Methoxy-6-p-(p-dimethylaminophenyl) aminoanilinofluoran
2-Chloro-3-methyl-6-p-(p-phenylaminophenyl) aminoanilinofluoran
2-Chloro-6-p-(p-dimethylaminophenyl)aminoanilinofluoran
2-Nitro-6-p-(p-diethylaminophenyl)aminoanilinofluoran
2-Amino-6-p-(p-diethylaminophenyl)aminoanilinofluoran
3-Diethylamino-6-p-(p-diethylaminophenyl) aminoanilinofluoran
2-Phenyl-6-metyl-p-(p-phenylaminophenyl) aminoanilinofluoran
2-Benzyl-6-p-(Phenylaminophenyl)aminoanilinofluoran
2-Hydroxy-6-p-(p-phenylaminophenyl)aminoanilinofluoran
3-Methyl-6-p-(p-dimethylaminophenyl) aminoanilinofluoran
3-Diethylamino-6-p-(p-diethylaminophenyl) aminoanilinofluoran
3-Diethylamino-6-p-(p-dibutylaminophenyl) aminoanilinofluoran <Fluorene Type Leuco Dyes>

3,6,6'-Tris(dimethylamino)spiro[fluorene-9,3'-phthalide]
3,6,6'-Tris(diethylamino)spiro[fluorene-9,3'-phthalide]

<Divinyl Type Leuco Dyes>

3,3-Bis-[2-(p-dimethylaminophenyl)-2-(p-methoxyphenyl) ethenyl]-4,5,6,7-tetrabromophthalide
3,3-Bis-[2-(p-dimethylaminophenyl)-2-(p-methoxyphenyl) ethenyl]-4,5,6,7-tetrachlorophthalide
3,3-Bis-[1,1-bis(4-pyrrolidinophenyl)ethylene-2-yl]-4,5,6,7-tetrabromophthalide
3,3-Bis-[1-(4-methoxyphenyl)1-(4-pyrrolidinophenyl) ethylene-2-yl]-4,5,6,7-tetrachlorophthalide <Others>

3-(4-Diethylamino-2-ethoxyphenyl)-3-(1-ethyl-2-methylindole-3-yl)-4-azaphthalide.
3-(4-Diethylamino-2-ethoxyphenyl)-3-(1-octyl-2-methylindole-3-yl)-4-azaphthalide
3-(4-Cyclohexylethylamino-2-methoxyphenyl)-3-(1-ethyl-2-methylindole-3-yl)-4-azaphthalide
3,3-Bis(1-ethy-2-methylindole-3-yl)phthalide
3,6-Bis(diethylamino)fluoran-γ-(3'-nitro)anilinolactam
3,6-Bis(diethylamino)fluoran-γ-(4'-nitro)anilinolactam
1,1-Bis-[2',2',2",2"-tetrakis-(p-dimethylaminophenyl)-ethenyl]-2,2-dinitrileethane
1,1-Bis-[2',2',2",2"-tetrakis-(p-dimethylaminophenyl)-ethenyl]-2,2-naphthoyleethane
1,1-Bis-[2',2',2",2"-tetrakis-(p-dimethylaminophenyl)-ethenyl]-2,2-diacetylethane
Bis-[2,2,2',2'-tetrakis-(p-dimethylaminophenyl)-ethenyl]-methylmalonic acid dimethyl ester.

In the present invention, a prior art color developer for color developing the dye precursor can be used in combination with the compound of Formula (1) as far as the desired effect on the object is not hindered. While it is better to avoid using a prior art color developer when a highly heat-resistant thermal recording medium ts produced. However, an appropriate amount of prior art color developer may be used in combination with the compound of Formula (1) of the present invention according to the heat resistance temperature characteristics to the objective thermal environment. Such a color developer includes a bisphenol A described in Japanese OPIs 3-207688, 5-24366, and the like, 4-hydroxybenzoic acid esters, 4-hydroxyphthalic acid diesters, phthalic acid monoesters, bis-(hydroxyphenyl) sulfides, 4-hydorxyphenylarylsulfones, 4-hydroxyphenylarylsulfonates, 1,3-di[2-(hydroxyphenyl)-2-propyl]-benzenes, 4-hydroxybenzoyloxybenzoic acid ester, and bisphenolsulfones. Typical examples of prior art color developer are shown below, but are not limited to these compounds.

<Bisphenols A>
4,4'-Isopropylidene-diphenol (Bisphenol A)
4,4'-Cyclohexylidene-diphenol
p,p'-(1-Methyl-n-hexylidene)-diphenol
1,7-di(4-hydroxyphenylthio)-3,5-dioxaheptane
<4-Hydroxybenzoic Acid Esters>
Benzyl 4-hydroxybenzoate
Ethyl 4-hydroxybenzoate
Propyl 4-hydroxybenzoate
Isopropyl 4-hydroxybenzoate
Butyl 4-hydroxybenzoate
Isobutyl 4-hydroxybenzoate
Methylbenzyl 4-hydroxybenzoate
<4-Hydroxyphthalic Acid Diesters>
Dimethyl 4-hydroxyphthalate
Diisopropyl 4-hydroxyphthalate
Dibenzyl 4-hydroxyphthalate
Dihexyl 4-hydroxyphthalate
<Phthalic Monoesters>
Monobenzyl phthalate
Monocyclohexyl phthalate
Monophenyl phthalate
Monomethylphenyl phthalate
Monoethylphenyl phthalate
Monopropylbenzyl phthalate
Monhalogenhenzyl phthalate
Monoethoxybenzyl phthalate
<Bis-(Hydroxyphenyl)-Sulfides>
Bis-(4-hydroxy-3-tert-butyl-6-methylphenyl)sulfide
Bis-(4-hydroxy-2,5-dimethylphenyl)sulfide
Bis-(4-hydroxy-2-methyl-5-ethylphenyl)sulfide
Bis-(4-hydroxy-2-methyl-5-isopropylphenyl)sulfide
Bis-(4-hydroxy-2,3-dimethylphenyl)sulfide
Bis-(4-hydroxy-2,5-dimethylphenyl)sulfide
Bis-(4-hydroxy-2,5-diisopropylphenyl)sulfide
Bis-(4-hydroxy-2,3,6-trimethylphenyl)sulfide
Bis-(2,4,5-trihydroxyphenyl)sulfide
Bis-(4-hydroxy-2-cyclohexyl-5-methylphenyl)sulfide
Bis-(2,3,4-trihydroxyphenyl)sulfide
Bis-(4,5-dihydroxy-2-tert-butylphenyl)sulfide
Bis-(4-hydroxy-2,5-diphenylphenyl)sulfide
Bis-(4-hydroxy-2-tert-octyl-5-methylphenyl)sulfide
<4=Hydroxyphenylarylsulfones>
4-Hydroxy-4'-isopropoxydiphenylsulfone
4-Hydroxy-4'-propoxydiphenylsulfone
4-Hydroxy-4'-n-butyloxydiphenylsulfone
4-Hydroxy-4'-n-propoxydiphenylsulfone
<4-Hydroxyphenylarylsulfonates>
4-Hydroxyphenylbenzenesulfonate
4-Hydroxyphenyl-p-tolylsulfonate
4-Hydroxyphenylmethylenesulfonate
4-Hydroxyphenyl-p-chlorobenzenesulfonate
4-Hydroxyphenyl-p-tert-butylbenzenesulfonate
4-Hydroxyphenyl-p-isopropoxybenzenesulfonate
4-Hydroxyphenyl-1'-naphthalenesulfonate
4-Hydroxyphenyl-2'-naphthalenesulfonate
<1,3-Di[2-(Hydroxyphenyl)-2-Propyl]Benzenes>
1,3-Di[2-(4-hydroxyphenyl)-2-propyl]benzene
1,3-Di[2-(4-hydroxy-3-alkylphenyl)-2-propyl]benzene
1,3-Di[2-(2,4-dihydroxyphenyl)-2-propyl]benzene
1,3-Di[2-(4-hydroxy-5-methylphenyl)-2-propyl]benzene
<Resorcinols>
1,3-Dihydroxy-6(α,α-dimethylbenzyl)benzene
<4-Hydroxybenzoyloxybenzoic Esters>
Benzyl 4-hydroxybenzoyloxybenzoate
Methyl 4-hydroxybenzoyloxybenzoate
Ethyl 4-hydroxybenzoyloxybenzoate
Propyl 4-hydroxybenzoyloxybenzoate
Butyl 4-hydroxybenzoyloxybenzoate
Isopropyl 4-hydroxybenzoyloxybenzoate
tert-Butyl 4-hydroxybenzoyloxybenzoate
Hexyl 4-hydroxybenzoyloxybenzoate
Octyl 4-hydroxybenzoyloxybenzoate
Nonyl 4-hydroxybenzoyloxybenzoate
Cyclohexyl 4-hydroxybenzoyloxybenzoate
β-Phenethyl 4-hydroxybenzoyloxybenzoate
Phenyl 4-hydroxybenzoyloxybenzoate
α-Naphthyl 4-hydroxybenzoyloxybenzoate
β-Naphthyl 4-hydroxybenzoyloxybenzoate
sec-Butyl 4-hydroxybenzoyloxybenzoate
<Bisphenolsulfones (I)>
Bis-(3-t-butyl-4-hydroxy-6-methylphenyl)sulfone
Bis-(3-ethyl-4-hydroxyphenyl)sulfone
Bis-(3-propyl-4-hydroxyphenyl)sulfone
Bis-(3-methyl-4-hydroxyphenyl)sulfone
Bis-(3-isopropyl-4-hydroxyphenyl)sulfone
Bis-(2-ethyl-4-hydroxyphenyl)sulfone
Bis-(3-chloro-4-hydroxyphenyl)sulfone
Bis-(2,3-dimethyl-4-hydroxyphenyl)sulfone
Bis-(2,5dimethyl-4-hydroxyphenyl)sulfone
Bis-(3-methoxy-4-hydroxyphenyl)sulfone
4-Hydroxyphenyl-2'-ethyl-4'-hydroxyphenylsulfone
4-Hydroxyphenyl-2'-isopropyl-4'-hydroxyphenylsulfone
4-Hydroxyphenyl-3'-isopropyl-4'-hydroxyphenylsulfone
4-Hydroxyphenyl-3'-sec-butyl-4'-hydroxyphenylsulfone
3-Chloro-4-hyydroxyphenyl-3'-isopropyl-4'-hydroxyphenylsulfone
2-Hydroxy-5-t-butylphenyl-4'-hydroxyphenylsulfone
2-Hydroxy-5-aminophenyl-4'-hydroxyphenylsulfone
2-Hydroxy-5-isopropylphenyl-4'-hydroxyphenylsulfone
2-Hydroxy-5-octylphenyl-4'-hydroxyphenylsulfone
2-Hydroxy-5-t-butylphenyl-3'-chloro-4'-hydroxyphenylsulfone
2-Hydroxy-5-t-butylphenyl-3'-methyl-4'-hydroxyphenylsulfone
2-Hydroxy-5-t-butylphenyl-3'-isopropyl-4'-hydroxyphenylsulfone
2-Hydroxy-5-t-butylphenyl-3'-chloro-4'-hydroxyphenylsulfone
2-Hydroxy-5-t-butylphenyl-3'-methyl-4'-hydroxyphenylsulfone
2-Hydroxy-5-t-butylphenyl-3'-isopropyl-4'-hydroxyphenylsulfone
2-Hydroxy-5-t-butylphenyl-2'-methyl-4'-hydroxyphenylsulfone <Bisphenylsulfones (II)>
4,4'-Sulfonyldiphenol
2,4'-Sulfonyldiphenol
3,3'-Dichloro-4,4'-sulfonyldiphenol
3,3'-Dibromo-4,4'-sulfonyldiphenol
3,3',5,5'-Tetrabromo-4,4'-sulfonyldiphenol
3,3'-Diamino-4,4'-sulfonyldiphenol
<Others>
p-tert-Butylphenol
2,4-Dihydroxybenzophenone
Novolac type phenolic resin
4-Hydroxyacetophenone
p-Phenylphenol
Benzyl 4-hydroxyphenylacetate
p-Benzylphenol In the present invention, a prior art sensitizer can be used as far as the desired effect on the object is not hindered. While it is in principle better not to use a sensitizer when a highly heat-resistant thermal recording medium is produced. However, an appropriate amount of sensitizer may be used according to the heat resistance temperature characteristics to the objective thermal environment. Such a sensitizer includes fatty acid amides such as stearamide, palmitamide, or the like; ethylene-bisamide, montan wax, polyethylene wax, 1,2-di-(3-methylphenoxy)ethane, p-benzylbiphenyl, βbenzyloxynaphthalene, 4-biphenyl-p-tolylether, m-terphenyl, 1,2-diphenoxyethane, benzyl oxalate, di(p-chlorobenzyl) oxalate, di(p-methylbenzyl) oxalate, dibenzyl terephthalate, benzyl p-benzyloxybenzoate, di-p-tolylcarbonate, p-benzylbiphenyl, phenyl-α-naphthylcarbonate, 1,4-diethoxynaphthalene, 1-hydroxy-2-naphthoic acid phenyl ester, o-xylylene-bis-(phenylether), and 4-(m-methylphenoxymethyl)biphenyl, but is not specifically limited to these compounds. These sensitizers may be used alone or as mixtures of two or more.

The binder used in the present invention can be can be completely-hydrolyzed polyvinylalcohol with a polymerization degree of 200 to 1,900, partially-hydrolyzed polyvinylalcohol, carboxy-modified polyvinylalcohol, amide-modified polyvinylalcohol, sulfonic acid-modified polyvinylalcohol, butyral-modified polyvinylalcohol, and other modified polyvinylalcohols; cellulose derivatives such as hydroxyethylcellulose, methylcellulose, ethylcellulose, carboxymethylcellulose, and acetylcellulose; styrene-maleic anhydride copolymer, styrene-butadiene copolymer, polyvinylchloride, polyvinylacetate, polyacrylamide, polyacrylic esters, polyvinylbutyral, polystyrene and its copolymers, polyamide resins, silicone resins, petroleum resins, terpene resins, ketone resins, and coumarone resins. These polymeric substances are used by dissolving in solvents such as water, alcohol, ketone, ester, and hydrocarbon or emulsified or dispersed in a paste-like state in water or other solvents, or can be used in combination according to the quality requirements.

In the present invention, it is also possible to add known stabilizers based on metal salts (Ca, Zn) of p-nitrobenzoic acid or metal salts (Ca, Zn) of monobenzylphthalate, which have an effect to endow the recorded image with oil resistance, as much as the desired effect on the object of the present invention is not hindered.

Fillers that can be used in the present invention can be inorganic or organic fillers such as such as silica, calcium carbonate, kaolin, calcined kaolin, diatomaceous earth, talc, titanium oxide, zinc oxide, aluminum hydroxide, polystyrene resin, urea-formaldehyde resin, styrene-methacrylic acid copolymer, styrene-butadiene copolymer, hollow plastic pigments, and the like.

In addition to the above, it is also possible to use release agents such as fatty acid metal salts, lubricant such as waxes, benzophenone- or triazole-based ultraviolet absorbers, waterproofing agents such as glyoxal, dispersing agents, defoamers, antioxidants, and the like.

The amounts of the color developer and the dye precursor used in the present invention and the types and amounts of other constituents are determined according to the required properties and recording adaptability, and are not specifically limited, but it is usually preferable to use 1 to 8 parts of the color developer of the present invention and 1 to 20 parts of the filler to 1 part of the dye precursor, and the binder is used in an amount of 10 to 25% of the total solid.

The substrate can be paper, synthetic paper, plastic films, non-woven fabrics, metal foils, or composite sheets thereof. The coating color of the above composition is coated on any type of substrate to obtain the objective thermal recording medium.

Furthermore, the medium can be provided with an overcoating layer comprising a polymeric substance on the thermal color developing layer to improve the storage stability, or with an undercoating layer containing an organic or inorganic filler between the color developing layer and the substrate to improve the storage stability and sensitivity.

The color developer, the dye precursor, and the materials which are added as necessary are dispersed by a dispersing machine such as a ball mill, an attritor, or a sand grinder, or by an appropriate emulsifying apparatus to a particle diameter of less than several microns, and mixed with the binder and various additives according to the purpose to obtain a coating color.

In the thermal recording medium of the present invention, a light absorbent which absorbs light to convert it to heat can be contained in the thermal recording layer to obtain an optically recordable thermal recording medium. The light absorbent may be a substance which absorbs the emission wavelength of various light sources, and various dyestuffs, pigments, or near-infrared absorbents can be used, which are not specifically limited.

When a stroboscopic flash lamp having continuous emission wavelength is used as a recording light source, the light absorbent for converting light to heat can be a heat reaction product of a thiourea derivative with a copper compound described in Japanese OPI 02-206583 or Japanese Patent Application 05-30954, graphite described in Japanese OPI 03-86580, copper sulfide, lead sulfide, molybdenum trisulfide, black titanium oxide, or the like, and carbon black can also be used. These light absorbents can also be used as a light absorbent for laser recording.

When a semiconductor laser, which is superior in terms of compact design, safety, cost, and modulation, is used as a recording laser, particularly when a semiconductor laser having an oscillation wavelength from the visible region to the near-infrared region is used, materials having absorptions adaptable to the oscillation wavelength include polymethine type dyes (cyanine dyes), azulenium type dyes, pyrylium type dyes, thiopyrylium type dyes, squarylium type dyes, croconium type dyes, dithiol-metal complex type dyes, mercaptophenol-metal complex type dyes, mercaptonaphthol-metal complex type dyes, phthalocyanine type dyes, naphthalocyanine type dyes, triarylmethane type dyes, immonium type dyes, diimmonium type dyes, naphthoquinone type dyes, anthraquinone type dyes, and metal complex type dyes which are disclosed in Japanese OPIs 54-4142, 58-94494, 58-209594, 02-217287, and 03-73814, and "Near Infrared Absorption Dyestuffs" (Chemical Industry, 43, May 1986).

The polymethine type dyes (cyanine dyes) include Indocyanine Green (made by Daiichi Seiyaku Co., Ltd.), NK-2014 (made by Nippon Kanko Shikiso Kenkyusho Co., Ltd.), NK-2612 (made by Nippon Kanko Shikiso Kenkyusho Co., Ltd.), 1,1,5,5-tetrakis(p-dimethylaminophenyl)-3-methoxy-1,4-pentadiene, 1,1,5,5-tetrakis(p-diethylaminophenyl)-3-methoxy-1,4-pentadiene, and the like; the squarylium dyes include NK-2772 (made by Nippon Kanko Shikiso Kenkyusho Co., Ltd.) and the like; the dithiol-metal complex type dyes include toluenedithiolnickel complex, 4-tert-butyl-1,2-benzenedithiolnickel complex, bisdithiobenzylnickel complex, PA-1005 (made by Mitsui. Toatsu Senryo Co., Ltd.), PA-1006 (made by Mitsui Toatsu Senryo Co., Ltd.), bis(4-ethyldithiobenzyl) nickel complex and bis(4-n-propyldithiobenzyl)nickel complex described in Japanese Patent Application 4-80646, and the like; the immonium type dyes or the diimmonium type dyes include IRG002 (made by Nippon Kayaku Co., Ltd.), IRG022 (made by Nippon Kayaku Co., Ltd.), and the like; the naphthalocyanine type dyes include NIR-4, NIR-14 (made by Yamamoto Kasei Co., Ltd.) and the like; and the anthraquinone type dyes include IR-750 (made by Nippon Kayaku Co., Ltd.) and the like. These light absorbents may be used alone or as mixtures of two or more types.

The light absorbent used in the optically recordable thermal recording medium of the present invention may be simply mixed in the materials required for the recording medium but, alternatively, as described in Japanese OPI 02-217287, can be previously melted or dispersed in the materials of the optically recordable thermal recording medium. Such materials in which the light absorbent is previously melted or dispersed are, for example, the thermal recording sensitizer, the color developer of the present invention, a prior art color developer, the dye precursor, a composition of a thermal recording sensitizer and the color developer of the present invention, a composition of the thermal recording sensitizer and a prior art color developer, and a composition of the thermal recording sensitizer and the dye precursor.

Further, the light absorbent used in the optically recordable thermal recording medium of the present invention can also be used in such a way that the materials of the inventive optically recordable thermal recording medium and the light absorbent are previously dissolved or dispersed in a solvent, the dissolved or dispersed mixture of the light absorbent and the materials are separated from the solvent, and then used. The materials with which the light absorbent is dissolved or dispersed in a solvent are similar to those materials shown above in which the light absorbent is previously melted or dispersed.

Further, the light absorbent used in the optically recordable thermal recording medium may be co-dispersed (simultaneously dispersed) with one of the dye precursor, color developer, and the sensitizer. Further, the light absorbent may co-dispersed (simultaneously dispersed) with a combination of the dye precursor with the sensitizer, or the color developer With the sensitizer.

The light absorbent used in the optically recordable recording medium, or the light absorbent melted, solvent-dissolved, or co-dispersed (simultaneously dispersed) with the above materials, may be mixed with the thermal color developing material comprising the color developer and the dye precursor, and used as a component of the materials of the light absorbent thermal recording layer. Further, the light absorbent may bre used as an ingredient of the light absorbent layer on or under the thermal recording layer comprising the color developer and dye precursor of the present invention. Further, the light absorbent may be used as an ingredient of the light absorbent layer on and under the thermal recording layer comprising the color developer and dye precursor of the present invention. Further, the light absorbent may be internally added or impregnated into the substrate to be used as a component of a light absorbent substrate. The thermal recording layer or the light absorbent thermal recording layer may be formed on the light absorbent substrate. The thermal recording layer or the light absorbent thermal recording layer on the light absorbent substrate may have a multilayered structure.

The amounts of the color developer and dye precursor used in the optically recordable thermal recording medium of the present invention, and types and amounts of other ingredients are determined by the required properties and recording adaptability, and are not specifically limited but, normally, based on one part of the dye precursor, 1 to 8 parts of the organic color developer, and 1 to 20 parts of the filler are used, and the binder is preferably used in an amount of 10 to 25% by weight to the total solid. The amount of the light absorbent is determined according to the required light absorbing ability.

The optically recordable thermal recording medium of the present invention, similar to the thermally recordable recording medium of the present invention, can be provided with an overcoating layer comprising a polymeric substance on top of the thermal recording layer to enhance the storage stability and sensitivity, or with an undercoating layer containing an organic or inorganic filler between the recording layer and the substrate. The light absorbent may be added to the overcoating layer or the undercoating layer.

The light absorbent is finely ground by a dispersing machine such as a ball mill, an attritor, or a sand grinder, or by an appropriate emulsifying apparatus to a particle diameter of less than several microns, and mixed with the binder and various additives according to the purpose to obtain a coating color.

The light source for achieving optical recording on the recording medium of the present invention can be various lasers such as semiconductor laser and a diode pumping YAG laser, a xenon flash lamp, and a halogen lamp. Light emitted from these light sources may be converged by a lens to irradiate the optical recording medium of the present invention. The light may also be scanned by a mirror to achieve optical scanning recording.

Since the thermal recording medium or the optically recordable thermal recording medium of the present invention is high in heat resistance and thermal stability of the background color, it can be heat laminated with a plastic film to provide a strong protective film. Therefore, before or after recording with heat or light, using a commercial laminator, it can be easily heat laminated with a plastic film using a commercial laminator to obtain a card protected with a plastic film with improved heat resistance and stabilities. In particular, the optically recordable thermal recording medium of the present invention can be additionally recorded through the laminated plastic film. The base material of the heat lamination plastic film includes polyethylene terephthalate (PET), polypropylene (PP), and the like, and the heat sealing agent for the heat lamination plastic film can be thermoplastic resins such as low-density polyethylene, ethylene/vinyl acetate copolymer (EVA), ethylene/ethyl acrylate copolymer (EEA), ethylene/methyl methacrylate copolymer (EMMA), and ethylene/methacrylic acid copolymer (EMAA).

In addition, the thermal recording medium or the optically recordable thermal recording medium of the present invention can be extrusion coated with an extrusion coating resin. The extrusion coating resin includes the thermoplastic resins usable for the above heat sealing agent, polypropylene (PP) and polyethylene terephthalate (PET).

Since the thermal recording medium or the optically recordable thermal recording medium of the present invention is superior in heat resistance, the background color will not be developed even if contacted with a thermal fixing unit of toner of an electrophotographic copier. Therefore, the recording medium can be used as an electrophotographic copy paper. Recording with heat or light is also possible before or after toner recording by an electrophotographic copier.

The reason why the aminobenzenesulfonamide derivative of Formula (1) of the present invention functions as a color developer of the dye precursor used in the recording medium recordable with heat or light, the reason why the thermal recording medium comprising the dye precursor and the color developer of the present invention exhibits a very high thermal resistance, and the reason why the optical recording medium comprising the dye precursor, the color developer of the present invention, and the optical absorbent exhibits a very high thermal resistance, have yet to be elucidated, but can be considered as follows.

Depending on the condition, the aminobenzenesulfonamide derivative of the present invention can undergo a structural change (keto-enol tautomerism when X is oxygen atom) from a neutral form to an acid form as shown below. It is considered that the acid form is required in order for these compounds to function as a color developer, and a high temperature is necessary for the tautomerism from the neutral form to the acid form.

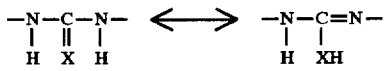

(Neutral form) (Acid form)

(wherein X is oxygen atom or sulfur atom.).

Since, for the thermally recordable recording medium, the thermal head for supplying heat momentarily has a high temperature of above 200° to 300° C., the compound of Formula (1) contained in the recording layer of the thermal recording medium contacting the thermal head undergoes the tautomerism to be the acid form, exhibiting the color developing function. This opens the lactone ring of the dye precursor to develop a color. Further, the aminosulfonyl group ($—SO_2NH_2$) is considered to contribute to promotion of the color developing function and stabilization of the acid form, thereby obtaining high recording image density and stability of the image and background color.

On the other hand, for the optically recordable thermal recording medium, since the optical absorbent is present in the optical recording layer, light emitted from the recording light source is efficiently absorbed by the optical absorbent to be converted to heat. At this moment, it becomes a high temperature of above 200° to 300° C., the Compound of Formula (1) contained in the recording layer undergoes the tautomerism as in the case of thermal recording, and becomes the acid form to exhibit the color developing function. This opens the lactone ring of the dye precursor to develop a color.

Further, since the compound of Formula (1) does not exhibit the color developing function nor react with the dye precursor until the transformation temperature to the acid form is reached, the background color will not be developed. This would be the reason for the high heat resistance. The temperature at which the compound of Formula (1) changes to the acid form (enol formation or thiol formation) is considered to be higher than the temperature required for heat lamination, and therefore the background color will not be developed even in a high-temperature environment such as in heat lamination.

Still further, since, for the optically recordable thermal recording medium of the above composition which is heat laminated, light emitted from the recording light source passes through the plastic film present on the optical recording layer, reaches the optical absorbent in the optical recording layer to be converted to heat, additional recording is possible even after lamination.

DETAILED DESCRIPTION OF EXAMPLES

Production of Thermal Recording Medium

Examples 1–56, Comparative Examples 1–6

The thermal recording medium of the present invention will now be described with reference to the Examples. In the following description, part and % indicate part by weight and % by weight, respectively.

Examples 1–44

Examples 1 to 44 use one of the compounds (A-1), (A-4), (A-6) to (A-8), (A-10), (A-12) to (A-15), (A-18) to (A-23), (A-25) to (A-28), (A-31), (A-32), (A-36) to (A-38), (A-40) to (A-46), (A-48), (A-51), (A-54), (B-1), (B-3), (B-5) to (B-7), (B-10), (B-13), (B-14), and (B-17) as a color developer, and 3-diethylamino-6-methyl-7-anilinofluoran (ODB) as a dye precursor.

A color developer dispersion (Solution A) and a dye precursor dispersion (Solution B) of the following compositions were separately wet milled by a sand grinder to an average particle diameter of 1 micron.

| Liquid A (color developer dispersion) | |
|---|---|
| Color developer | 6.0 parts |
| 10% Aqueous polyvinylalcohol solution | 18.8 |
| Water | 11.2 |
| Liquid B (dye precursor dispersion) | |
| 3-Diethylamino-6-methyl-7-anilinofluoran (ODB) | 2.0 parts |
| 10% Aqueous polyvinylalcohol solution | 4.6 |
| Water | 2.6 |

Next, the dispersions were mixed in the following ratio to obtain a coating color.

| | |
|---|---|
| Liquid A (color developer dispersion) | 36.0 parts |
| Liquid B (dye precursor [ODB] dispersion) | 9.2 |
| Kaolin clay (50% dispersion) | 12.0 |

The coating color was coated on one side of a 50 $g/m^2$ base paper, dried, and treated by a supercalender to a degree of smoothness(Bekk Smooth) of 500 to 600 seconds to obtain a thermal recording medium with a coating weight of 6.0 $g/m^2$.

Examples 45–56

Examples 45–56 use the compound of (A-10) or (A-19) as a color developer and the following dye precursors other than ODB.

| (Dye precursor) |
|---|
| ODB-2: 3-dibutylamino-6-methyl-7-anilinofluoran |
| Green 40: 3-diethylamino-7-(o-chloroanilino)fluoran. |
| PSD-150: 3-(N-cyclohexyl-N-methylamino)-6-methyl-7-anilinofluoran |
| CVL: 3,3-bis(p-dimethylaminophenyl)-6-dimethylaminophthalide |

The dye precursor dispersions other than ODB (Liquid C) were separately wet milled by a sand grinder to an average particle diameter of 1 micron.

| Liquid C (dye precursor dispersion other than ODB) | |
|---|---|
| Dye precursor | 2.0 parts |
| 10% Aqueous polyvinylalcohol solution | 4.6 |
| Water | 2.6 |

Next, the dispersions were mixed in the following ratio to obtain a coating color.

| | |
|---|---|
| Liquid A (A-10 or A-19 color developer dispersion) | 36.0 parts |
| Liquid C (dye precursor dispersion other than ODB) | 9.2 |
| Kaolin clay (50% dispersion) | 12.0 |

The coating color was coated on one side of a 50 g/m$^2$ base paper, dried, and treated by a supercalender to a degree of smoothness(Bekk Smooth) of 500 to 600 seconds to obtain a thermal recording medium with a coating weight of 6.0 g/m$^2$.

Examples 53 and 54

Example 53 uses the compound (A-10) as a color developer, and ODB and PSD-150 as dye precursors. The color developer dispersion (Liquid A) and the ODB dispersion (Liquid B) were treated as in Examples 1–44, and the PSD-150 dispersion (Liquid C) was treated as in Examples 45–52.

| | |
|---|---|
| Liquid A (color developer [A-10] dispersion) | 36.0 parts |
| Liquid B (dye precursor [ODB] dispersion) | 4.6 |
| Liquid C (dye precursor [PSD-150] dispersion) | 4.6 |
| Kaolin clay (50% dispersion) | 12.0 |

The coating color was coated on one side of a 50 g/m$^2$ base paper, dried, and treated by a supercalender to a degree of smoothness (Bekk Smooth) of 500 to 600 seconds to obtain a thermal recording medium with a coating weight of 6.0 g/m$^2$.

Example 54 uses the compound (A-10) as a color developer, and ODB-2 and PSD-150 as dye precursors. The color developer dispersion (Liquid A) was treated as in Examples 1–44, and the ODB-2 dispersion (Liquid C) and the PSD-150 dispersion (Liquid C) were treated as in Examples 45–52.

| | |
|---|---|
| Liquid A (color developer [A-10] dispersion) | 36.0 parts |
| Liquid C (dye precursor [ODB-2] dispersion) | 4.6 |
| Liquid C (dye precursor [PSD-150] dispersion) | 4.6 |
| Kaolin clay (50% dispersion) | 12.0 |

The coating color was coated on one side of a 50 g/m$^2$ base paper, dried, and treated by a supercalender to a degree of smoothness(Bekk Smooth) of 500 to 600 seconds to obtain a thermal recording medium with a coating weight of 6.0 g/m$^2$.

Examples 55 and 56

Example 55 uses the compounds (A-1) and (A-10) as color developers, and ODB as a dye precursor. The color developers (A-1) and (A-10) dispersions (Liquid A) and the ODB dispersion (Liquid B) were treated as in Examples 1–44.

| | |
|---|---|
| Liquid A (color developer [A-1] dispersion) | 18.0 parts |
| Liquid A (color developer [A-10] dispersion) | 18.0 parts |
| Liquid B (dye precursor [ODB] dispersion) | 9.2 |
| Kaolin clay (50% dispersion) | 12.0 |

The coating color was coated on one side of a 50 g/m$^2$ base paper, dried, and treated by a supercalender to a degree of smoothness (Bekk Smooth) of 500 to 600 seconds to obtain a thermal recording medium with a coating weight of 6.0 g/m$^2$.

Example 56 uses the compound (A-10) and bisphenol A (hereinafter referred to as BPA) as color developers, and ODB as a dye precursor. The color developer (A-10) dispersion (Liquid A) and the ODB dispersion (Liquid B) were treated as in Examples 1–44. Further, the BPA dispersion (Liquid D) as a prior art color developer was wet milled by a sand grinder to an average particle diameter of 1 micron.

| Liquid D (prior art color developer [BPA] dispersion) | |
|---|---|
| Bisphenol A (BPA) | 6.0 parts |
| 10% Aqueous polyvinylalcohol solution | 18.8 |
| Water | 11.2 |

Next, the dispersions were mixed in the following ratio to obtain a coating color.

| | |
|---|---|
| Liquid A (color developer [A-10] dispersion) | 30.0 parts |
| Liquid D (prior art color developer [BPA] dispersion) | 6.0 |
| Liquid B (dye precursor [ODB] dispersion) | 9.2 |
| Kaolin clay (50% dispersion) | 12.0 |

The coating color was coated on one side of a 50 g/m$^2$ base paper, dried, and treated by a supercalender to a degree of smoothness(Bekk Smooth) of 500 to 600 seconds to obtain a thermal recording medium with a coating weight of 6.0 g/m$^2$.

Comparative Examples 1–6

Comparative Examples 1–6 use the following prior art color developers and the dye precursors shown in Examples 45–52.

(Prior Art Color Developers)

BPA: bisphenol A

D-8: 4-hydroxy-4'-isopropoxydiphenylsulfone

Comparative samples of thermal recording medium 1 were prepared using the same procedure as in Examples 1–44. The BPA dispersion (Liquid D) was treated as in Example 56, and the D-8 dispersion (Liquid D') was wet milled by a sand grinder to an average particle diameter of 1 micron.

| Liquid D' (prior art color developer [D-8] dispersion | |
|---|---|
| D-8 | 6.0 parts |
| 10% Aqueous polyvinylalcohol solution | 18.8 |
| Water | 11.2 |

Next, the dispersions were mixed in the following ratio to obtain a coating color.

| | |
|---|---|
| Liquid D or D' (prior art color developer dispersion) | 36.0 parts |
| Liquid B or C (dye precursor dispersion) | 9.2 |
| Kaolin clay (50% dispersion) | 12.0 |

The coating color was coated on one side of a 50 g/m$^2$ base paper, dried, and treated by a supercalender to a degree of smoothness(Bekk Smooth) of 500 to 600 seconds to obtain a thermal recording medium with a coating weight of 6.0 g/m$^2$.

Evaluation of Thermal Recording Medium

Examples 1–56, Comparative Examples 1–6

The thermal recording medium of Examples 1–56 and Comparative Examples 1–6 were tested for thermal recordability and heat stability of background color (Table 1: recording density and background color stability of thermal recording medium of Examples 1–22), Table 2: recording density and background color stability of thermal recording medium of Examples 23–44), Table 3: recording density and background color stability of thermal recording medium of Examples 45–56), and Table 4: recording density and background color stability of thermal recording medium of Comparative Examples 1–6).

Thermal recording was performed on the thermal recording medium of Examples 1–56 and Comparative Examples 1–6 using a printer of a personal word processor Rupo-90FII (Toshiba) at a maximum application energy (same condition used for the subsequent tests). Recording density of the recorded portion was measured by means of a Macbeth densitometer (RD-914, amber filter used, hereinafter the same condition used).

A sufficient recording density was obtained with the thermal recording medium of Examples 1–56 using the compounds of the present invention as color developers by the above printer. However, Examples using a dye precursor other than black showed a low value because the amber filter was used for the recording density measurement.

Heat Stability Test of Background Color

Using a Gear type aging tester (Toyoseiki Seisakusho), the thermal recording medium of Examples 1–56 and Comparative Examples 1–6 were subjected to a heat resistance test at 100° C., 120° C., and 140° C. for 30 minutes. After the heat resistance test, the background density was measured by a Macbeth densitometer. In this case, the smaller the value of Macbeth density, the smaller development of background color, and the higher the heat stability of background color.

While the thermal recording medium of Examples 1–56 using the compounds of the present invention as color developers had no samples exceeding 0.4 in background density after 30 minutes at 140° C. and exceeding 0.2 in background density after 30 minutes at 120° C., all of the thermal recording medium of Comparative Examples 1–6 using the phenolic color developer exceeded a density of 0.5 even after 30 minutes at 100° C. The thermal recording medium of Examples 1–56 were high in contrast between the recorded image and background color even after 30 minutes at 140° C., showing a very high heat stability.

TABLE 1

Recording density and background stability of Examples 1–22

| Example | Color developer | Dye precursor | Recording density | Background density before treatment | Heat resistance test of background (density after 30 min) 100° C. | 120° C. | 140° C. |
|---|---|---|---|---|---|---|---|
| Ex. 1 | Comp. A-1 | ODB | 1.32 | 0.03 | 0.08 | 0.19 | 0.35 |
| Ex. 2 | Comp. A-4 | ODB | 1.35 | 0.03 | 0.08 | 0.19 | 0.36 |
| Ex. 3 | Comp. A-6 | ODB | 1.33 | 0.03 | 0.08 | 0.18 | 0.33 |
| Ex. 4 | Comp. A-7 | ODB | 1.31 | 0.03 | 0.07 | 0.17 | 0.31 |
| Ex. 5 | Comp. A-8 | ODB | 1.32 | 0.03 | 0.08 | 0.19 | 0.36 |
| Ex. 6 | Comp. A-10 | ODB | 1.36 | 0.03 | 0.06 | 0.13 | 0.17 |
| Ex. 7 | Comp. A-12 | ODB | 1.41 | 0.03 | 0.06 | 0.15 | 0.21 |
| Ex. 8 | Comp. A-13 | ODB | 1.39 | 0.03 | 0.06 | 0.13 | 0.16 |
| Ex. 9 | Comp. A-14 | ODB | 1.29 | 0.03 | 0.06 | 0.11 | 0.13 |
| Ex. 10 | Comp. A-15 | ODB | 1.35 | 0.03 | 0.05 | 0.11 | 0.13 |
| Ex. 11 | Comp. A-18 | ODB | 1.33 | 0.03 | 0.06 | 0.13 | 0.16 |
| Ex. 12 | Comp. A-19 | ODB | 1.36 | 0.03 | 0.05 | 0.10 | 0.12 |
| Ex. 13 | Comp. A-20 | ODB | 1.29 | 0.03 | 0.05 | 0.09 | 0.11 |
| Ex. 14 | Comp. A-21 | ODB | 1.40 | 0.03 | 0.05 | 0.13 | 0.17 |
| Ex. 15 | Comp. A-22 | ODB | 1.39 | 0.03 | 0.04 | 0.10 | 0.11 |
| Ex. 16 | Comp. A-23 | ODB | 1.25 | 0.03 | 0.04 | 0.07 | 0.10 |
| Ex. 17 | Comp. A-25 | ODB | 1.36 | 0.03 | 0.04 | 0.07 | 0.10 |
| Ex. 18 | Comp. A-26 | ODB | 1.32 | 0.03 | 0.05 | 0.10 | 0.11 |
| Ex. 19 | Comp. A-27 | ODB | 1.35 | 0.03 | 0.05 | 0.09 | 0.13 |
| Ex. 20 | Comp. A-28 | ODB | 1.27 | 0.03 | 0.07 | 0.18 | 0.32 |
| Ex. 21 | Comp. A-31 | ODB | 1.21 | 0.03 | 0.07 | 0.17 | 0.32 |
| Ex. 22 | Comp. A-32 | ODB | 1.30 | 0.03 | 0.07 | 0.17 | 0.30 |

TABLE 2

Recording density and background Color stability thermal recording medium of Examples 23–44

| Example | Color developer | Dye precursor | Recording density | Background density before treatment | Heat resistance test of background (density after 30 min) 100° C. | 120° C. | 140° C. |
|---|---|---|---|---|---|---|---|
| Ex. 23 | Comp. A-36 | ODB | 1.30 | 0.03 | 0.07 | 0.17 | 0.30 |
| Ex. 24 | Comp. A-37 | ODB | 1.28 | 0.03 | 0.06 | 0.12 | 0.14 |
| Ex. 25 | Comp. A-38 | ODB | 1.30 | 0.03 | 0.06 | 0.12 | 0.14 |
| Ex. 26 | Comp. A-40 | ODB | 1.27 | 0.03 | 0.06 | 0.11 | 0.13 |
| Ex. 27 | Comp. A-41 | ODB | 1.31 | 0.03 | 0.06 | 0.11 | 0.13 |
| Ex. 28 | Comp. A-42 | ODB | 1.23 | 0.03 | 0.06 | 0.11 | 0.14 |
| Ex. 29 | Comp. A-43 | ODB | 1.22 | 0.03 | 0.05 | 0.10 | 0.12 |
| Ex. 30 | Comp. A-44 | ODB | 1.29 | 0.03 | 0.06 | 0.11 | 0.13 |
| Ex. 31 | Comp. A-45 | ODB | 1.33 | 0.03 | 0.05 | 0.10 | 0.12 |
| Ex. 32 | Comp. A-46 | ODB | 1.24 | 0.02 | 0.04 | 0.08 | 0.11 |
| Ex. 33 | Comp. A-48 | ODB | 1.16 | 0.02 | 0.04 | 0.08 | 0.11 |
| Ex. 34 | Comp. A-51 | ODB | 1.11 | 0.02 | 0.04 | 0.08 | 0.10 |
| Ex. 35 | Comp. A-54 | ODB | 1.30 | 0.03 | 0.04 | 0.08 | 0.11 |
| Ex. 36 | Comp. B-1 | ODB | 1.30 | 0.03 | 0.08 | 0.19 | 0.36 |
| Ex. 37 | Comp. B-3 | ODB | 1.33 | 0.03 | 0.05 | 0.12 | 0.18 |
| Ex. 38 | Comp. B-5 | ODB | 1.38 | 0.03 | 0.05 | 0.14 | 0.23 |
| Ex. 39 | Comp. B-6 | ODB | 1.33 | 0.03 | 0.04 | 0.08 | 0.13 |
| Ex. 40 | Comp. B-7 | ODB | 1.25 | 0.03 | 0.04 | 0.07 | 0.12 |
| Ex. 41 | Comp. B-10 | ODB | 1.24 | 0.03 | 0.07 | 0.17 | 0.33 |
| Ex. 42 | Comp. B-13 | ODB | 1.22 | 0.03 | 0.05 | 0.10 | 0.14 |
| Ex. 43 | Comp. B-14 | ODB | 1.15 | 0.03 | 0.05 | 0.09 | 0.13 |
| Ex. 44 | Comp. B-17 | ODB | 1.18 | 0.02 | 0.05 | 0.09 | 0.11 |

TABLE 3

Recording density and background stability of Examples 45–56

| Example | Color developer | Dye precursor | Recording density | Background density before treatment | Heat resistance test of background (density after 30 min) 100° C. | 120° C. | 140° C. |
|---|---|---|---|---|---|---|---|
| Ex. 45 | Comp. A-10 | ODB-2 | 1.39 | 0.03 | 0.04 | 0.10 | 0.13 |
| Ex. 46 | Comp. A-10 | Green 40 | 1.08 | 0.02 | 0.03 | 0.04 | 0.06 |
| Ex. 47 | Comp. A-10 | PSD-150 | 1.35 | 0.03 | 0.04 | 0.09 | 0.12 |
| Ex. 48 | Comp. A-10 | CVL | 1.20 | 0.02 | 0.03 | 0.05 | 0.08 |
| Ex. 49 | Comp. A-19 | ODB-2 | 1.38 | 0.03 | 0.03 | 0.06 | 0.09 |
| Ex. 50 | Comp. A-19 | Green 40 | 1.07 | 0.02 | 0.02 | 0.02 | 0.03 |
| Ex. 51 | Comp. A-19 | PSD-150 | 1.36 | 0.03 | 0.03 | 0.05 | 0.08 |
| Ex. 52 | Comp. A-19 | CVL | 1.18 | 0.02 | 0.02 | 0.03 | 0.05 |
| Ex. 53 | Comp. A-10 | ODB/PSD-150 | 1.37 | 0.03 | 0.07 | 0.14 | 0.18 |
| Ex. 54 | Comp. A-10 | ODB-2/PSD-150 | 1.40 | 0.03 | 0.05 | 0.11 | 0.14 |
| Ex. 55 | Comp. A-1/A-10 | ODB | 1.35 | 0.03 | 0.07 | 0.16 | 0.29 |
| Ex. 56 | Comp. A-10/BPA | ODB | 1.43 | 0.03 | 0.02 | 0.17 | 0.31 |

TABLE 4

Recording density and background stability of Comparative Examples 1–6

| Example | Color developer | Dye precursor | Recording density | Background density before treatment | Heat resistance test of background (density after 30 min) 100° C. | 120° C. | 140° C. |
|---|---|---|---|---|---|---|---|
| Comp. Ex. 1 | BPA | ODB | 1.44 | 0.05 | 0.63 | 1.24 | 1.33 |
| Comp. Ex. 2 | BPA | ODB2 | 1.45 | 0.03 | 0.60 | 1.19 | 1.30 |
| Comp. Ex. 3 | BPA | Green 40 | 1.15 | 0.03 | 0.55 | 1.15 | 1.28 |
| Comp. Ex. 4 | D-8 | ODB | 1.50 | 0.04 | 0.94 | 1.27 | 1.24 |
| Comp. Ex. 5 | D-8 | PSD150 | 1.47 | 0.04 | 0.91 | 1.27 | 1.25 |
| Comp. Ex. 6 | D-8 | CVL | 1.26 | 0.03 | 0.58 | 1.02 | 1.13 |

Heat Lamination and Toner Recording Test

Examples 57–72 Comparative Examples 7–9

Next, as various heat treatment tests, the thermal recording medium of the present invention were subjected to heat lamination and toner recording by an electrophotographic copier (Table 5: Various heat treatment tests of thermal recording medium of Examples 1, 4, 6 to 8, 12, 13, 26, 31, 37, 39, 44, 45, and 54 to 56; and Comparative Examples 1, 2, and 4).

Heat Lamination Test

A simple lamination apparatus (MS POUCH H-140, Meiko Shokai) and a lamination film (MS POUCH FILM MP10-6095) were used. The thermal recording medium of Examples 1, 4, 6 to 8, 12, 13, 26, 31, 37, 39, 44, 45, and 54 to 56, and Comparative Examples 1, 2, and 4, which were already subjected to thermal recording under the above-described condition, were placed between the above lamination films, and fed at a feed speed of 20 mm/sec to obtain heat-laminated thermal recording medium having thermal recording portions (Examples 57–72, Comparative Examples 7–9). After heat lamination, the color developed portions by the thermal recording and the background portions were measured through the lamination film of the laminated thermal recording medium for density by the Macbeth densitometer (greater values were given because measurement was made through the film). For the background color, the smaller the Macbeth density value, the more stable the background color. Contrast between the color developed portions and the background color of the laminated thermal recording medium was evaluated as follows:

Good: No or almost no color developing of the background (heat lamination possible)

Poor: Considerable color developing of the background.

The laminated thermal recording medium with a contrast evaluation of "Poor" were difficult to read, and substantially impossible to be heat laminated (Comparative Examples 7 to 9). On the other hand, Examples 57–72 gave good contrast evaluation (Good), and were possible to be heat laminated.

Toner Recording Test by an Electrophotographic Copier

The thermal recording medium (partly thermal recorded) of Examples 1, 4, 6 to 8, 12, 13, 26, 31, 37, 39, 44, 45, and 54 to 56, and Comparative Examples 1, 2, and 4 were toner recorded as paper for an electrophotographic copier (Vivace 400: Fuji Xerox). Usability as paper of an electrophotographic copier was evaluated according to the degree of background color development (evaluation criteria of contrast between the color developed portion and background color portion are the same as in heat lamination test).

The thermal recording medium of the present invention (Examples 1, 4, 6 to 8, 12, 13, 26, 31, 37, 39, 44, 45, and 54 to 56) had almost no development of background color, a sufficient contrast between the color developed portion and the background color portion, and were possible to be used as paper for an electrophotographic copier (Examples 57–72).

TABLE 5

Various heat treatment tests of the thermal recording medium of Examples 1, 4, 6 to 8, 12, 13, 26, 31, 37, 39, 44, 45, and 54 to 56, and Comparative Examples 1, 2, and 4

| | Thermal recording | Heat lamination test Macbeth density | | | Toner recordability by copier | |
|---|---|---|---|---|---|---|
| Example No. | medium used (No. *1) | Colored portion | Background portion | Contrast evaluation | Background portion | Evaluation |
| Ex. 57 | (Ex. 1) | 1.61 | 0.13 | Good | 0.09 | Good |
| Ex. 58 | (Ex. 4) | 1.58 | 0.12 | Good | 0.08 | Good |
| Ex. 59 | (Ex. 6) | 1.78 | 0.13 | Good | 0.07 | Good |
| Ex. 60 | (Ex. 7) | 1.83 | 0.14 | Good | 0.07 | Good |
| Ex. 61 | (Ex. 8) | 1.79 | 0.13 | Good | 0.07 | Good |
| Ex. 62 | (Ex. 12) | 1.79 | 0.11 | Good | 0.06 | Good |
| Ex. 63 | (Ex. 13) | 1.55 | 0.12 | Good | 0.06 | Good |
| Ex. 64 | (Ex. 26) | 1.68 | 0.13 | Good | 0.06 | Good |
| Ex. 65 | (Ex. 31) | 1.75 | 0.12 | Good | 0.06 | Good |
| Ex. 66 | (Ex. 37) | 1.55 | 0.11 | Good | 0.06 | Good |
| Ex. 67 | (Ex. 39) | 1.43 | 0.12 | Good | 0.05 | Good |
| Ex. 68 | (Ex. 44) | 1.62 | 0.12 | Good | 0.06 | Good |
| Ex. 69 | (Ex. 45) | 1.58 | 0.10 | Good | 0.05 | Good |
| Ex. 70 | (Ex. 54 | 1.61 | 0.10 | Good | 0.06 | Good |
| Ex. 71 | (Ex. 55) | 1.55 | 0.12 | Good | 0.07 | Good |
| Ex. 72 | (Ex. 56) | 1.66 | 0.17 | Good | 0.12 | Good |
| Comp. Ex. 7 | (Comp. Ex. 1) | 1.96 | 1.96 | Poor | 1.08 | Poor |
| Comp. Ex. 8 | (Comp. Ex. 2) | 1.99 | 1.86 | Poor | 1.01 | Poor |
| Comp. Ex. 9 | (Comp. Ex. 4) | 1.99 | 1.92 | Poor | 1.05 | Poor |

*1: Example and Comparative Example Nos. are shown in Tables 1–4.

Production of Optically Recordable Thermal Recording Medium

Examples 73 to 77, Comparative Example 10

The optically recordable thermal recording medium of the present invention will now be describes with reference to the Examples. In the following description, part and % indicate part by weight and % by weight, respectively.

Examples 73–77

Examples 73–77 use one of the compounds (A-1), (A-7), (A-10), (A-12), and (A-19) as a color developer, a heat melt of bis(1-methyl-3,4-dithiophenolate)nickeltetra-n-butylammonium and a sensitizer as an optical absorbent, and 3-diethylamino-6-methyl-7-anilinofluoran (ODB) as a dye precursor.

The color developer dispersion (Liquid A) and the dye precursor dispersion (Liquid B) used in Examples 1–44, and the optical absorbent dispersion (Liquid E) of the following composition were separately wet milled by a sand grinder to an average particle diameter of 1 micron.

Liquid E (Optical Absorbent Dispersion)

94 Parts of 4-biphenyl-p-tolylether was mixed with 6 parts of bis(1-methyl-3,4-dithiophenolate)nickeltetra-n-butylammonium, heated to 100° to 150° C. to melt, and crushed to obtain an optical absorbent.

| | |
|---|---|
| Optical absorbent | 4.0 parts |
| 10% Aqueous polyvinylalcohol solution | 10.0 |
| Water | 6.0 |

Next, the dispersions were mixed in the following ratio to obtain a coating color.

| | |
|---|---|
| Liquid A (color developer dispersion) | 36.0 parts |
| Liquid E (optical absorbent dispersion) | 20.0 |
| Liquid B (dye precursor [ODB] dispersion) | 9.2 |
| Kaolin clay (50% dispersion) | 12.0 |

The coating color was coated on one side of a 50 g/m$^2$ base paper and dried to obtain an optically recordable thermal recording medium with a coating weight of 6.0 g/m$^2$.

Comparative Example 10

Comparative Example 10 is a comparative example to the optically recordable thermal recording medium of the present invention, which uses bisphenol A (BPA) shown in Comparative Examples 1–3 as a prior art color developer, a heat melt of bis(1-methyl-3,4-dithiophenolate)nickeltetra-n-butyl ammonium and a sensitizer as an optical absorbent, and ODB shown in Examples 1–44 as a dye precursor.

The color developer dispersion (BPA: Liquid D) was prepared as in Example 56, the optical absorbent dispersion (Liquid E) was prepared as in Examples 73–77, the dye precursor dispersion was prepared as in Examples 1–44, and the dispersions were mixed in the following ratio to obtain a coating color.

| | |
|---|---|
| Liquid D (color developer [BPA] dispersion) | 36.0 parts |
| Liquid E (optical absorbent dispersion) | 20.0 |
| Liquid B (dye precursor [ODB] dispersion) | 9.2 |
| Kaolin clay (50% dispersion) | 12.0 |

The coating color was coated on one side of a 50 g/m$^2$ base paper and dried to obtain an optically recordable thermal recording medium with a coating weight of 6.0 g/m$^2$.

Evaluation of Optically Recordable Thermal Recording Medium

Examples 73–77, Comparative Example 10

The optically recordable thermal recording medium of Examples 73–77 and Comparative Example 10 were subjected to an optical recording test and a thermal stability test of background color (Table 6: optical recording density and background color heat stability of the optically recordable thermal recording medium of Examples 73–77 and Comparative Example 10).

Optical Recording Test 1

The optically recordable thermal recording medium of Examples 73–77 and Comparative Example 10 were laser recorded by the following method using a laser plotter described in Japanese OPI 03-239598. The optical recording light source was a 30 mW semiconductor laser LT015MD (Sharp) with an oscillation wavelength of 830 nm, and two units of aspheric plastic lenses AP4545 (Konica) with a numerical aperture of 0.45 and a focal length of 4.5 mm were used as focusing lenses. A laser recording head comprising the semiconductor laser and the lenses was scanned at a recording speed of 50 mm/sec and a recording line interval of 50 microns to obtain a 1-cm square overall colored image. The 1-cm square overall color image was measured for density by a Macbeth densitometer (RD-914, amber filter used). The values are shown in "optical recording density 1" of Table 6.

The optically recordable thermal recording medium of Examples 73–77 using the compounds of the present invention gave sufficient recording densities by the laser recording.

Optical Recording Test 2

Optical recording was made on the optically recordable thermal recording medium of Examples 73–77 and Comparative Example 10 using stroboscopic flash light. In optical recording, a light emitting window of a camera stroboscopic flash lamp auto4330 (SUNPACK) was narrowed to 5%, which was used for irradiating the recording medium. The color developed image was measured for density by the Macbeth densitometer (RD-914, an amber filter used). The measured values are shown in "optical recording density 2" of Table 6.

Background Color Heat Stability Test (Optically Recordable Thermal Recording Medium)

As in the heat stability test of thermal recording medium, using a dear type aging tester (Toyoseiki Seisakusho), the optically recordable thermal recording medium of Examples 73–77 and Comparative Example 10 were subjected to a heat resistance test at 100° C., 120° C., and 140° C. for 30 minutes. After the heat resistance test, the backgrgund density was measured by a Macbeth densitometer. In this case, the smaller the value of Macbeth density, the smaller development of background color, and the higher the heat stability of background color.

While the optically recordable thermal recording medium of Examples 73–77 using the compounds of the present invention as color developers had no samples exceeding 0.4 in background density after 30 minutes at 140° C. and exceeding 0.2 in background density after 30 minutes at 120° C., the optically recordable thermal recording medium of Comparative Example 10 using the phenolic color developer far exceeded a density of 0.4 even after 30 minutes at 100° C. The optically recordable thermal recording medium of Examples 73–77 were high in contrast between the recorded image and background color even after 30 minutes at 140° C., showing a very high heat stability.

TABLE 6

Optical recording density and background stability of optically recordable thermal recording medium of Examples 73–77 and Comparative Example 10

| Example | Color developer | Optical recording density 1 | Optical recording density 2 | Background density before treatment | Heat resistance test of background (density after 30 min) 100° C. | 120° C. | 140° C. |
|---|---|---|---|---|---|---|---|
| Ex. 73 | Comp. A-1 | 1.11 | 1.18 | 0.07 | 0.12 | 0.23 | 0.39 |
| Ex. 74 | Comp. A-7 | 1.09 | 1.15 | 0.07 | 0.11 | 0.21 | 0.33 |
| Ex. 75 | Comp. A-10 | 1.17 | 1.24 | 0.07 | 0.10 | 0.16 | 0.20 |
| Ex. 76 | Comp. A-12 | 1.21 | 1.28 | 0.07 | 0.10 | 0.16 | 0.19 |
| Ex. 77 | Comp. A-19 | 1.16 | 1.23 | 0.07 | 0.09 | 0.14 | 0.17 |
| Comp. Ex. 10 | BPA | 1.25 | 1.29 | 0.07 | 1.12 | 1.20 | 1.31 |

Heat Lamination Test and Toner Recording Test

Examples 78–82, Comparative Example 11

Next, as various heat treatment tests, the optically recordable thermal recording medium of the present invention were subjected to heat lamination and toner recording by an electrophotographic copier (Table 7: Various heat treatment tests of optically recordable thermal recording medium of Examples 73–77 and Comparative Example 10).

Heat Lamination Test

A simple lamination apparatus (MS POUCH H-140, Meiko Shokai) and a lamination film (MS POUCH FILM MP10-6095) were used. The optically recordable thermal recording medium of Examples 73–77 and Comparative Example 10, which were already subjected to optical recording (optical recording test 1) under the above-described condition, were placed between the above lamination films, and fed at a feed speed of 20 mm/sec to obtain heat-laminated optically recordable thermal recording medium having optical recording portions (Examples 78–82, Comparative Example 11). After heat lamination, the color developed portions by the optical recording and the background portions were measured through the lamination film of the laminated optically recordable thermal recording medium for density by the Macbeth densitometer. For the background color, the smaller the Macbeth density value, the more stable the background color. Contrast between the color developed portions and the background color of the laminated optically recordable thermal recording medium was evaluated as follows:

Good: No or almost no color developing of the background (heat lamination possible)

Poor: Considerable color developing of the background.

The laminated optically recordable thermal recording medium with a contrast evaluation of "Poor" was difficult to read, and substantially impossible to be heat laminated (Comparative Example 11). On the other hand, Examples 78–82 gave good contrast evaluation (Good), and were possible to be heat laminated.

Toner Recording Test by an Electrophotographic Copier

The optically recordable thermal recording medium of Examples 73–77 and Comparative Example 10, which were already subjected to optical recording (optical recording test 1 or optical recording test 2), were toner recorded as paper for an electrophotographic copier (Vivace 400: Fuji Xerox). Usability as paper of an electrophotographic copier was evaluated according to the degree of background color development and the contrast between the color developed portion and background color portion (evaluation criteria are the same as in "heat lamination test").

The optically recordable thermal recording medium of the present invention had almost no development of background color, and a sufficient contrast between the color developed portion and the background color portion, and were possible to be used as paper for an electrophotographic copier (Examples 78–82).

TABLE 7

Various heat treatment tests of the optically recordable thermal recording medium of Examples 73–77 and Comparative Example 10

| Example No. | Optical recording medium used (No. *2) | Heat lamination test: Macbeth density: Optical recording density 1 | Optical recording density 2 | Background | Contrast evaluation | Toner recordability by copier: Background portion | Evaluation |
|---|---|---|---|---|---|---|---|
| Ex. 78 | (Ex. 73) | 1.51 | 1.58 | 0.17 | Good | 0.13 | Good |
| Ex. 79 | (Ex. 74) | 1.50 | 1.57 | 0.16 | Good | 0.12 | Good |
| Ex. 80 | (Ex. 75) | 1.58 | 1.65 | 0.17 | Good | 0.11 | Good |
| Ex. 81 | (Ex. 76) | 1.63 | 1.68 | 0.17 | Good | 0.11 | Good |
| Ex. 82 | (Ex. 77) | 1.55 | 1.66 | 0.15 | Good | 0.10 | Good |
| Comp. Ex. 11 | (Comp. Ex. 10) | 1.99 | 1.99 | 1.99 | Poor | 1.10 | Poor |

*2: Example and Comparative Example Nos. are shown in Table 6.

As described above, while the thermal recording medium or the optically recordable thermal recording medium of the present invention using the compounds of Formula (1) cause almost no fogging of the background color until a temperature environment of about 120° to 140° C., can give a practically sufficient image recording density by a thermal recording device such as a thermal head or an optical recording device using a laser or a stroboscopic flash. Therefore, the present invention provides the following effects.

(1) The thermal recording medium or the optically recordable thermal recording medium can be used under extreme conditions (e.g. 90° to 140° C.) under which prior art recording medium could not be used.

(2) Since the thermal or optical recorded medium can be heat laminated by a heat laminator, a thermally or optically recordable thermal recording card can be easily prepared.

(3) The laminated optically recordable thermal recording medium can be further recorded by additional optical recording.

(4) Since the background color is stable even after passing through a heat roll, the thermal recording or optically recordable thermal recording medium can be used as paper for an electrophotographic copier.

What is claimed is:

1. A thermal recording medium comprising substrate having thereon a recording layer containing a colorless or pale colored dye precursor, and a color developer reactable with the dye precursor to develop a color as main ingredients, wherein the color developer includes at least one compound of Formula (1) with the dye precursor to develop a color as main ingredients, wherein the color developer includes at least one compound of Formula (1):

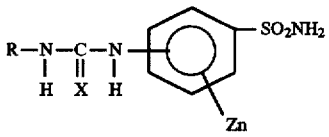

(1)

oxygen atom or sulfur atom; and R is a substituted or unsubstituted group which is selected from the group consisting of phenyl group, naphthyl group, aralkyl group, a lower alkyl group of 1 to 6 carbon atoms, cycloalkyl group, and a lower alkenyl group of 2 to 6 carbon atoms, Z is a lower alkyl group of 1 to 6 carbon atoms or an electron attracting group and n is an integer from 0 to 4.

2. A thermal recording medium comprising a substrate having thereon a recording layer containing a colorless or pale colored dye precursor, and a color developer reactable with the dye precursor to develop a color as main ingredients, wherein the color developer includes at least one compound of Formula (2):

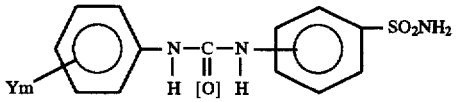

(2)

X wherein X is oxygen atom or sulfur atom, Y is a lower alkyl group of 1 to 6 carbon atoms or an electron attracting group and m is an integer from 0 to 3.

3. A thermal recording medium according to claim 2, comprising a color developer, wherein the color developer includes at least one compound of Formula:

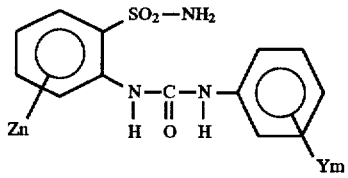

wherein Y is a member selected from the group consisting of ethyl, methoxy, chlorine, bromine, nitro and CN and m is an integer from 0 to 3, Z is bromine and n is an integer from 0 to 1.

4. A thermal recording medium according to claim 2 comprising a color developer, wherein the color developer includes at least one compound of Formula:

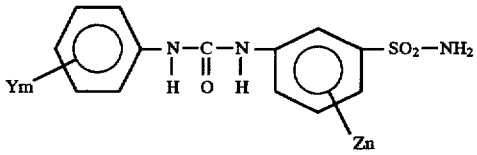

wherein Z is chlorine and n is an integer from 0 to 2, Y is a member selected from the group consisting of methyl, methoxy, chlorine, bromine and nitro and m is an integer from 0 to 2.

5. A thermal recording medium according to claim 2 comprising a color developer, wherein the color developer includes at least one compound of Formula:

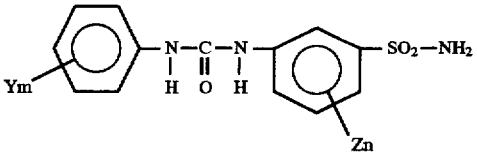

wherein Y is a member selected from the group consisting of methyl, chlorine, fluorine, methoxy and nitro and m is an integer from 0 to 2, and Z is chlorine and n is an integer of 0 to 2.

6. The optically recordable thermal recording medium of claim 1 containing an optical absorbent for absorbing and convering light to heat.

7. The thermal recording medium of claim 1, claims 2 or claim 3, wherein the recording surface of the entire recording medium is laminated with a plastic film.

8. The thermal recording medium of claim 1 wherein the R group includes a substituent selected from the group consisting of methyl, ethyl, isopropenyl, fluorine, chlorine, bromine and nitro.

9. The thermal recording medium of claim 1, wherein Z is a member selected from the group consisting of methyl, ethyl, fluorine, chlorine, bromine and nitro.

10. A thermal recording medium according to claim 1 comprising a color developer, wherein the color developer includes at least one compound of Formula:

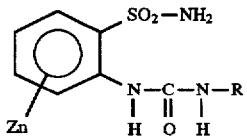

R is a substituted or unsubstituted group selected from the group consisting of an alkyl group having 1 to 3 carbon atoms, a cyclohexyl group, a propenyl group and a naphthyl group, wherein the alkyl group may contain a phenyl substituent, a methyl phenyl substituent or a propenyl phenyl substitutent, and Z is methyl and n is an integer of from 0 to 1.

11. The thermal recording medium of claim 10 wherein the alkyl group is a member selected from the group consisting of methyl, isopropyl and propenyl.

12. A thermal recording medium according to claim 1 comprising a color developer, wherein the color developer includes at least one compound of Formula:

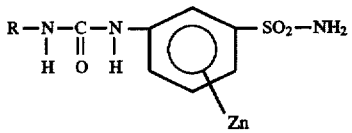

R is a substituted or unsubstituted group selected from the group consisting of an alkyl group having 1 to 3 carbon atoms, a cyclohexyl group, a propenyl group and a naphthyl group, wherein the alkyl group may contain a phenyl substituent, a chlorophenyl substituent or a propenyl phenyl substitutent, and Z is methyl or chlorine and n is an integer of from 0 to 3.

13. The thermal recording medium of claim 12 wherein the alkyl group is a member selected from the group consisting of methyl, isopropyl, propyl and propenyl.

14. A thermal recording medium according to claim 1 comprising a color developer, wherein the color developer includes at least one compound of Formula:

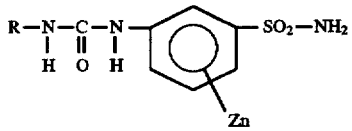

R is a substituted or unsubstituted group selected from the group consisting of an alkyl group having 1 to 3 carbon atoms, a cyclohexyl group, a methyl cyclohexyl group, a vinyl group and naphthyl group, wherein the alkyl group may contain a phenyl substituent, a bromo phenyl substituent or a propenyl phenyl substitutent, and Z is bromine and n is an integer of from 0 to 2.

15. The thermal recording medium of claim 14 wherein the alkyl group is a member selected from the group consisting of methyl, isopropyl and propenyl.

16. A thermal recording medium comprising a substrate having thereon a recording layer containing a colorless or pale colored dye precursor, and a color developer reactable with the dye precursor to develop a color as main ingredients, wherein the color developer includes at least one compound of Formula:

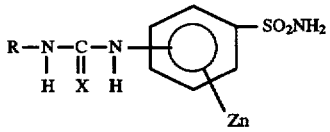

(1)

wherein X is sulfur atom; and R is a substituted or unsubstituted group which is selected from the group consisting of phenyl group, naphthyl group, aralkyl group, a lower alkyl group of 1 to 6 carbon atoms, cycloalkyl graup, and a lower alkenyl group of 2 to 6 carbon atoms, Z is a lower alkyl group of 1 to 6 carbon atoms or an electron attracting group, and n is an integer from 0 to 4.

17. The thermal recording medium of claim 16, wherein the R group includes a substituent selected from the group consisting of methyl, ethyl, isopropenyl, fluorine, chlorine, bromine and nitro.

18. The thermal recording medium of claim 16, wherein Z is a member selected from the group consisting of methyl, ethyl, fluorine, chlorine, bromine and nitro.

19. A thermal recording medium according to claim 16 comprising a color developer, wherein the color developer includes at least one compound of Formula:

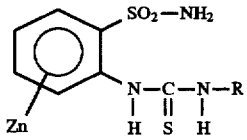

R is a substituted or unsubstituted alkyl group having 1 to 3 carbon atoms wherein the alkyl group may contain a phenyl substituent or a propenyl phenyl substituent and Z is methyl and n is an integer of from 0 to 1.

20. The thermal recording medium of claim 19 wherein the alkyl group is a member selected from group consisting of methyl, isopropyl and propyl.

21. A thermal recording medium according to claim 16 comprising color developer, wherein the color developer includes at least one compound of Formula:

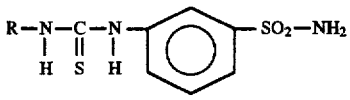

R is a substituted or unsubstituted group selected from the group consisting of an alkyl group having 1 to 3 carbon atoms, a cyclohexyl group, and a naphthyl group, wherein the alkyl group may contain a propenyl phenyl substituent.

22. The thermal recording medium of claim 21, wherein the alkyl group is isopropyl.

23. A thermal recording medium according to claim 16 comprising a color developer, wherein the color developer includes at least one compound of Formula:

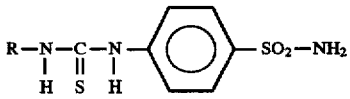

R is a substituted or unsubstituted group selected from the group consisting of an alkyl group having 1 to 3 carbon atoms, a cyclohexyl group and a propenyl group, wherein the alkyl group may contain a phenyl substituent.

24. The thermal recording medium of claim 23 wherein the alkyl group is methyl.

25. A thermal recording medium comprising a substrate having thereon a recording layer containing a colorless or pale colored dye precursor, and a color developer reactable with the dye precursor to develop a color as main ingredients, wherein the color developer includes at least one compound of Formula:

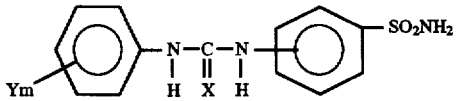

(2)

wherein X is sulfur atom, Y is a lower alkyl group of 1 to 6 carbon atoms or an electron attracting group, and m is an integer from 0 to 3.

26. The optically recordable thermal recording medium of claim 16 or claim 25 containing an optical absorbent for absorbing and converting light to heat.

27. The thermal recording medium of claim 16 or claim 25, wherein the recording surface of the entire recording medium is laminated with a plastic film.

28. A thermal recording medium according to claim 25 comprising a color developer, wherein the color developer includes at least one compound of Formula:

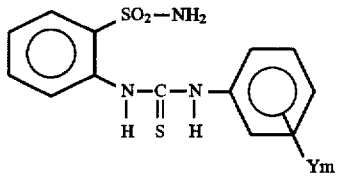

wherein Y is methoxy and m is an integer from 0 to 1.

29. A thermal recording medium according to claim 25 comprising a colordeveloper, wherein the color developer includes at least one compound of Formula:

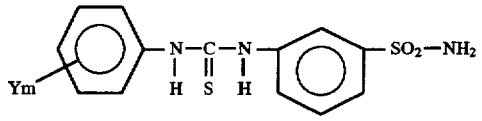

wherein Y is chlorine and m is an integer from 0 to 2.

30. A thermal recording medium according to claim 25 comprising color developer, wherein the color developes includes at least one compound of Formula:

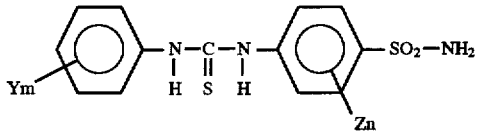

wherein Y is a member selected from the group consisting of methyl, methoxy and chlorine and m is an integer from 0 to 1, and Z is chlorine and n is an integer from 0 to 4.

* * * * *